US007531769B2

(12) United States Patent
Smith

(10) Patent No.: US 7,531,769 B2
(45) Date of Patent: May 12, 2009

(54) CARBON FIBER COMPOSITE MUFFLE

(76) Inventor: Guy Smith, 11883 Pearl Rd., Apt 207, Strongsville, OH (US) 44136

( * ) Notice: Subject to any disclaimer, the term of this patent is extended or adjusted under 35 U.S.C. 154(b) by 40 days.

(21) Appl. No.: 11/423,825

(22) Filed: Jun. 13, 2006

(65) Prior Publication Data

US 2007/0287118 A1 Dec. 13, 2007

(51) Int. Cl.

| | |
|---|---|
| ***F27B 5/14*** | (2006.01) |
| ***F27B 5/16*** | (2006.01) |
| ***F27D 1/18*** | (2006.01) |
| ***F27D 7/06*** | (2006.01) |
| ***F27D 11/00*** | (2006.01) |
| ***F27D 15/02*** | (2006.01) |
| ***C21D 1/767*** | (2006.01) |
| ***C21D 1/773*** | (2006.01) |

(52) U.S. Cl. ..... 219/390; 219/400; 373/111; 373/112; 373/113; 266/250; 266/252; 266/255; 266/259; 62/62

(58) Field of Classification Search ..... None
See application file for complete search history.

(56) References Cited

U.S. PATENT DOCUMENTS

| | | | | |
|---|---|---|---|---|
| 3,860,222 | A | | 1/1975 | Tennenhouse |
| 4,195,820 | A | | 4/1980 | Berg |
| 4,279,952 | A | * | 7/1981 | Kodama et al. ..... 373/137 |
| 4,610,435 | A | | 9/1986 | Pfau |
| 4,709,904 | A | | 12/1987 | Schmetz |
| 4,846,680 | A | * | 7/1989 | Olav et al. ..... 432/248 |
| 4,970,372 | A | | 11/1990 | Fleiter et al. |
| 5,121,903 | A | | 6/1992 | Ripley et al. |
| 5,267,257 | A | * | 11/1993 | Jhawar et al. ..... 373/113 |
| 5,271,545 | A | | 12/1993 | Boswell |
| 5,533,930 | A | * | 7/1996 | Tsuzuki et al. ..... 432/206 |
| 5,886,326 | A | * | 3/1999 | Tang ..... 110/250 |
| 6,216,358 | B1 | | 4/2001 | Pelisser |
| 6,369,361 | B2 | | 4/2002 | Saito |
| 6,533,991 | B1 | | 3/2003 | Moller |
| 6,576,874 | B2 | * | 6/2003 | Zapata et al. ..... 219/400 |
| 6,756,566 | B2 | | 6/2004 | Moller |
| 6,821,114 | B2 | | 11/2004 | Kisoda |
| 6,903,306 | B2 | | 6/2005 | Moller |
| 6,913,449 | B2 | | 7/2005 | Loeser et al. |

* cited by examiner

*Primary Examiner*—Joseph M Pelham
(74) *Attorney, Agent, or Firm*—Lindon & Lindon LLC; James Lindon

(57) ABSTRACT

A vacuum furnace adapted to cool a load. The vacuum furnace has one or more means for cooling a fluid and a muffle substantially comprised of carbon fiber composite and substantially containing the load. The fluid flows in a substantially unidirectional flow substantially within the muffle.

5 Claims, 48 Drawing Sheets

CARBON FIBER COMPOSITE MUFFLE

BACKGROUND OF THE INVENTION

Many vacuum furnaces used to heat and/or cool a load within specified tolerances can not cool parts rapidly without using high gas pressures or more expensive gases (hydrogen, helium). There is a long-felt need for an improved furnace, including an improved vacuum furnace and an improved muffle.

SUMMARY OF THE INVENTION

The above advantages as well as other advantages not specifically enumerated are achieved by a vacuum furnace adapted to cool a load. The vacuum furnace includes one or more means for cooling a fluid and a muffle substantially comprised of carbon fiber composite and substantially containing the load. The fluid flows in a substantially unidirectional flow substantially within the muffle Various advantages of this invention will become apparent to those skilled in the art from the following detailed description of the preferred embodiment, when read in light of the accompanying drawings.

DETAILED DESCRIPTION OF THE INVENTION

Figure 1:
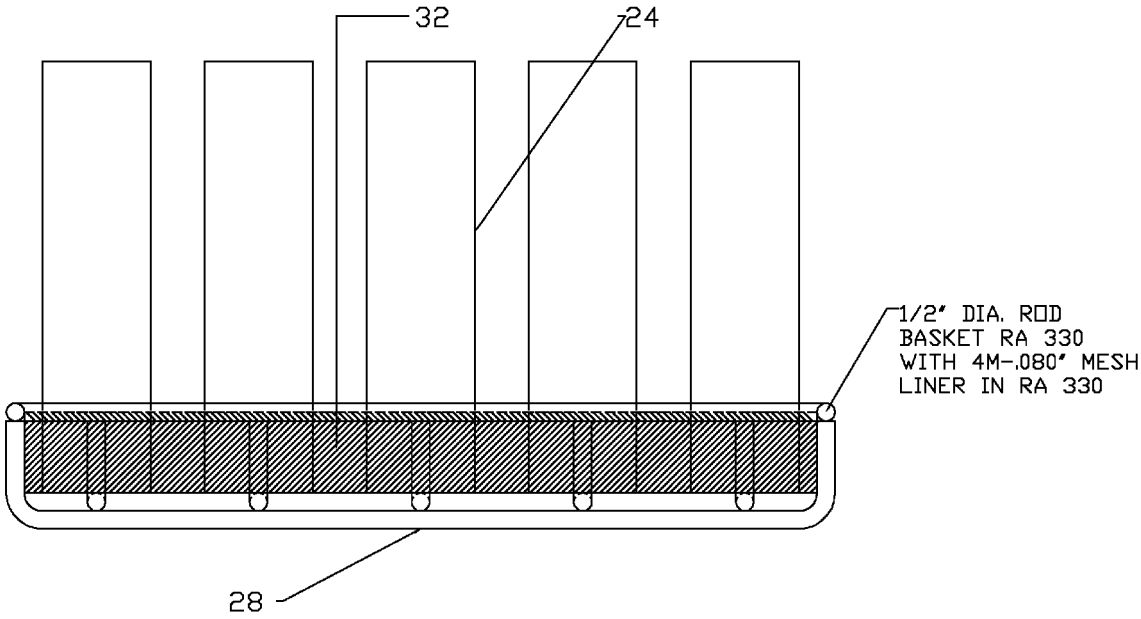
FIG. 1. is a view in elevation of a load shown elsewhere in a carbon fiber composite muffle according to the invention FIG. 2. is a top plan view the load of FIG. 1
Figure 2:
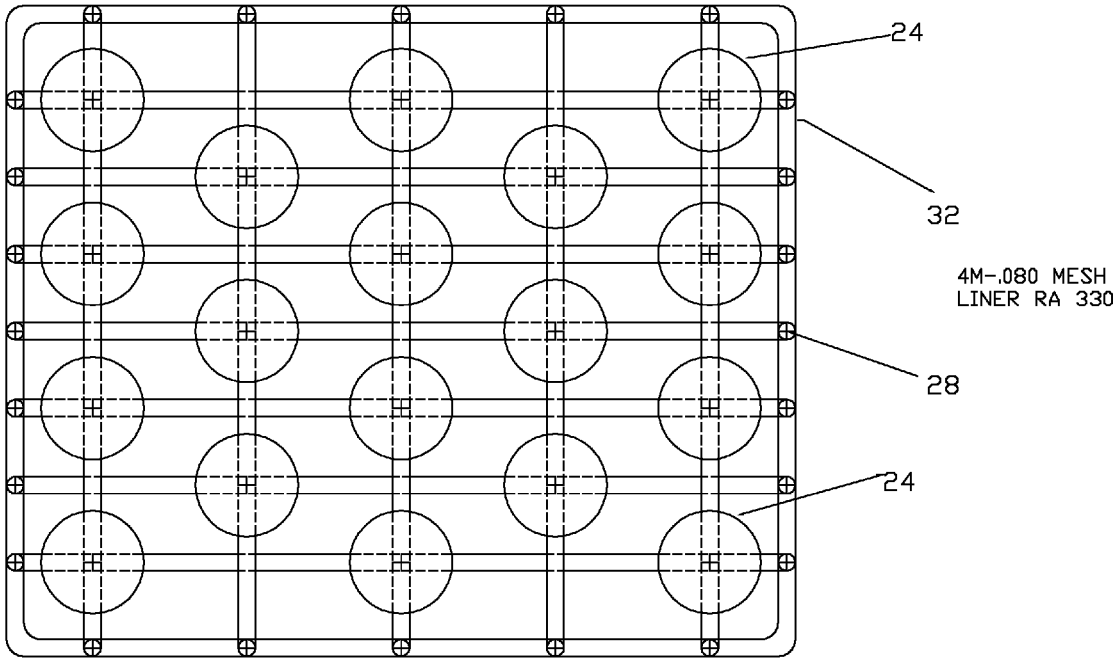

Preliminarily, it should be noted that certain terms used herein, such as for example "left", "right", "front", "rear", "top", "bottom", and the like are used to facilitate the description of the invention. Unless otherwise specified or made apparent by the context of the discussion, such terms and other directional terms should be interpreted with reference to the figure(s) under discussion. Such terms are not intended as a limitation on the position in which the invention or components may be used. Indeed, it is contemplated that the components of the invention may be orientated for use as desired. Likewise, numerical terms such as for example "first", and "second" are not intended as a limitation or to imply a sequence, unless otherwise specified or made apparent by the context of the discussion.

There is a need for consistent heating and/or cooling a load within variance or tolerance. For example, aerospace applications may require a five degree variance in the heating and/or cooling of a load within a hot zone. The term "load" is understood to include a quantity of material placed into a device, such as for example a furnace, at one time. A load may include work pieces or parts to be heated, cooled, or otherwise treated. The load may be so treated in a hot zone. The term "hot zone" with respect to a furnace is understood to include a region or area set off from those surrounding or adjoining. In general, the less time required to cool a load, the stronger or harder that load will be. The heating and/or cooling may be done by flowing a suitable fluid over and/or through the load. The term "fluid" is understood to include any suitable substance, including any suitable liquid and/or gas, that is capable of flowing. Non-limiting examples of suitable fluids which may be employed with the present invention include inert gases, hydrogen, nitrogen, helium, krypton, argon, neon, and the like.

Referring now to the drawings, there is shown a furnace, indicated generally at 20, having a load 24. The furnace 20 shown in FIGS. 3, 4, 5, 6, 7, 8 and 9 is oriented generally horizontally. The illustrated load 24 is shown as a series, five in particular, of cylindrical members in a rod frame basket 28 with a wire mesh liner 32. The furnace shown in FIGS. 10, 11, 12, 13, and 14 is oriented generally vertically.

Figure 3:
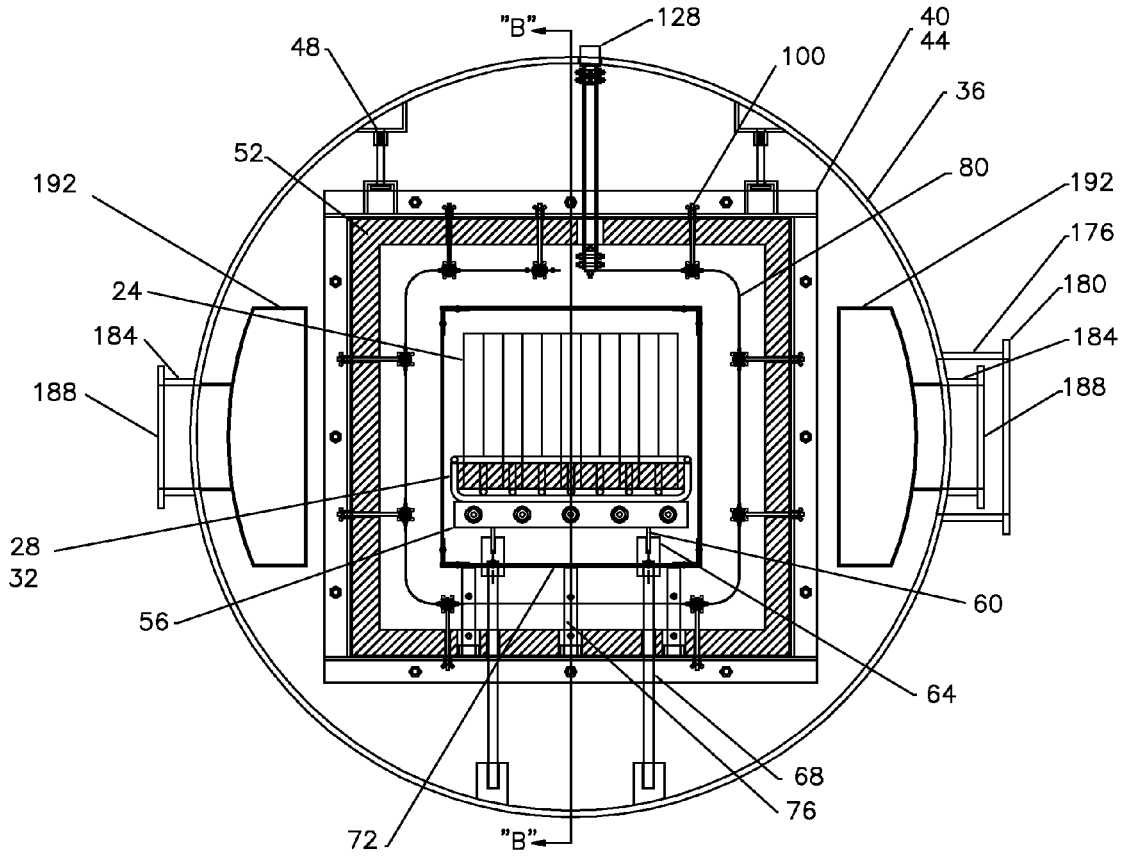
FIG. 3. is an end section view of a rectangular muffle in a generally horizontal furnace FIG. 4. is a side section view of a rectangular muffle in a generally horizontal furnace FIG. 5. is a top plan view of a rectangular muffle in a generally horizontal furnace in cooling mode FIG. 6. is a section view of a front door in a generally horizontal furnace FIG. 7. is a section view of a rear door in a generally horizontal furnace FIG. 8. is a top view of a muffle in a generally horizontal furnace in cooling mode with a turntable in a hot zone FIG. 9. is a side view of a muffle in a generally horizontal furnace with a turntable in a hot zone FIG. 10. is a side view of a generally rectangular muffle in a generally vertical furnace FIG. 11. is a top section view (of the top door) of a generally rectangular muffle in a generally vertical furnace FIG. 12. is a section view of a generally rectangular muffle bottom door in a generally vertical furnace FIG. 13. is a section view of a generally rectangular muffle in a generally vertical furnace FIG. 14. is a side view of a generally rectangular muffle in a generally vertical furnace in cooling mode FIG. 15. is a heating element support assembly FIG. 16. shows a hearth support element FIG. 17. shows power feed assembly details FIG. 18. shows the muffle supports and the shell supports FIG. 19. shows heating element assembly details FIG. 20. is a hot zone shell hanger assembly (two views)

Referring now primarily to FIG. 3, the illustrated furnace 20 is a vacuum furnace. The illustrated furnace 20 includes a vacuum chamber wall 36 which generally surrounds a hot zone shell 40 and an angle iron frame 44. The vacuum chamber wall 36 defines a chamber within. A hot zone shell hanger assembly 48 is provided to suspend and/or support the hot zone shell 40 and the angle iron frame 44. The hot zone shell hanger assembly 48 is shown secured to the vacuum chamber wall 36. A layer of thermal insulation 52 is also provided as shown.

The rod frame basket 28 is shown supported by a serpentine grid 56. The serpentine grid 56 is shown supported by two hearth bars 60, though any suitable number may be employed. The hearth bars 60 are shown along the length of the serpentine grid 56. The hearth bars 60 are shown supported by hearth post caps 64. The hearth post caps 64 are shown supported by hearth posts 68. A refractory metal may be employed for the construction of the hearth bars 60, the hearth post caps 64, and the hearth posts 68.

Figure 24:
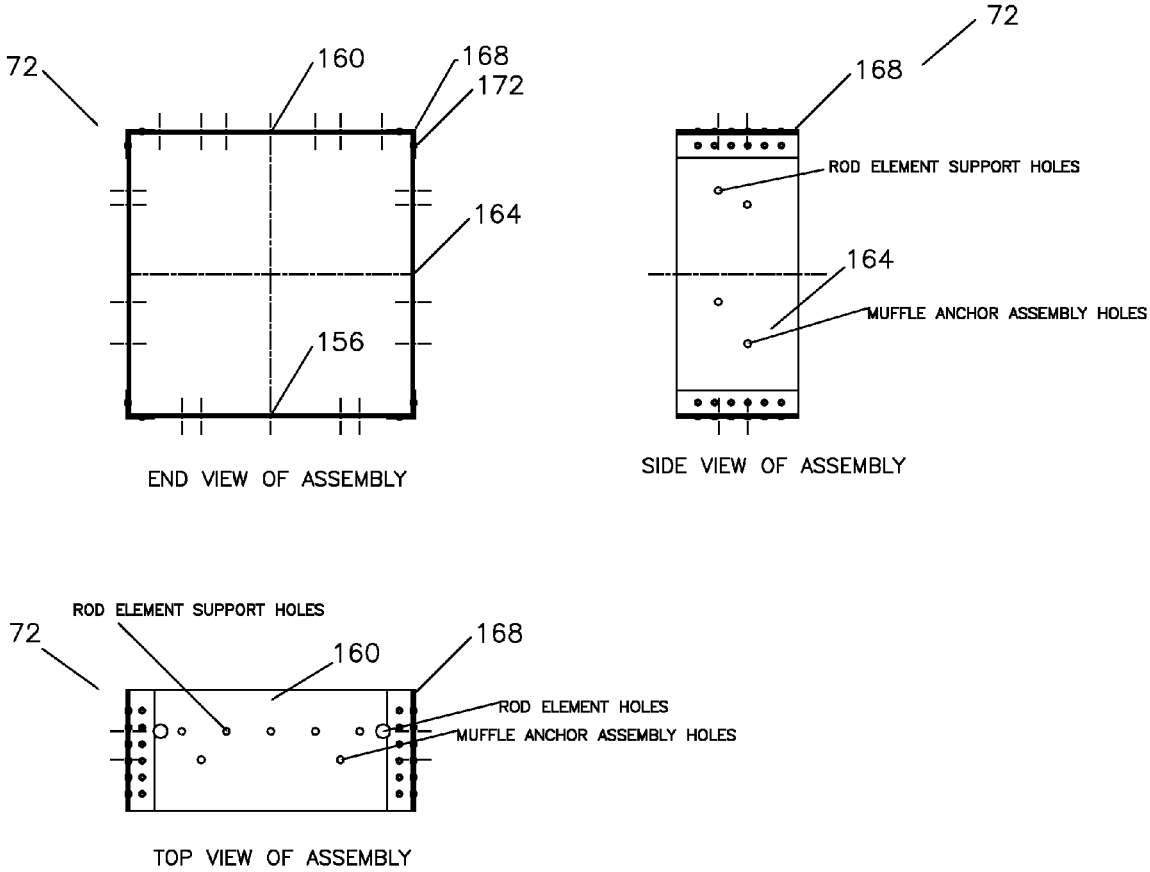
FIG. 24. is a horizontal generally shorter muffle assembly, three views, useable with the generally horizontal furnace of FIG. 4
Figure 25:
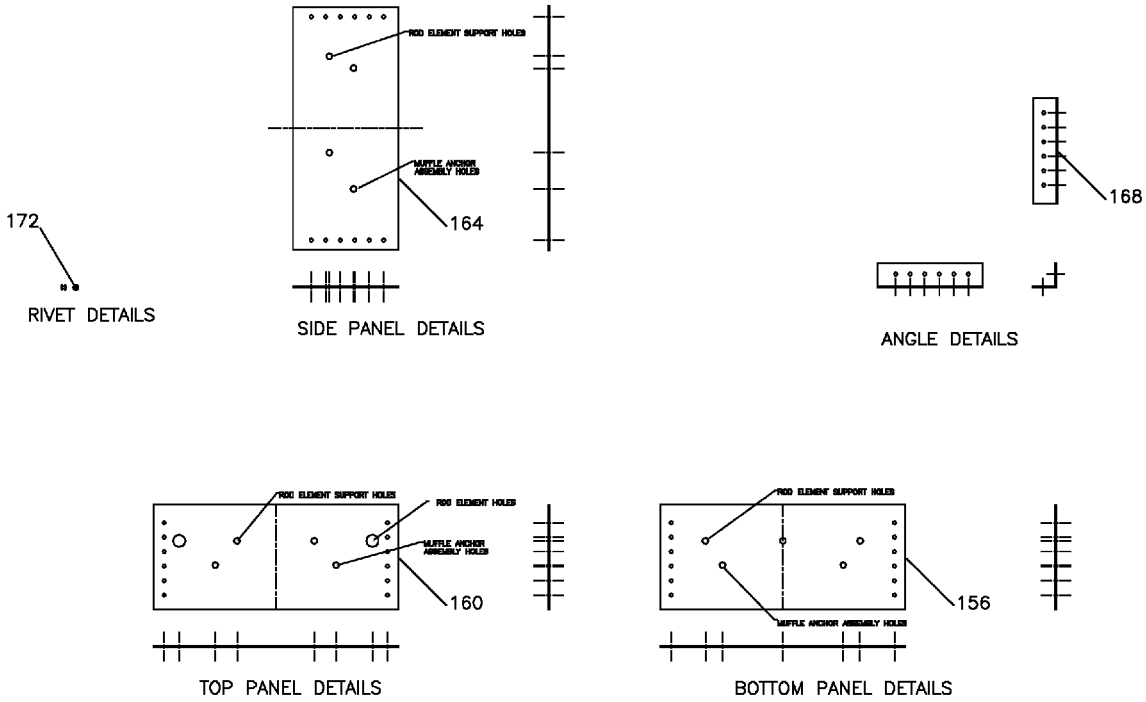
FIG. 25. shows a horizontal generally shorter muffle details useable with the generally horizontal furnace of FIG. 4
Figure 26:
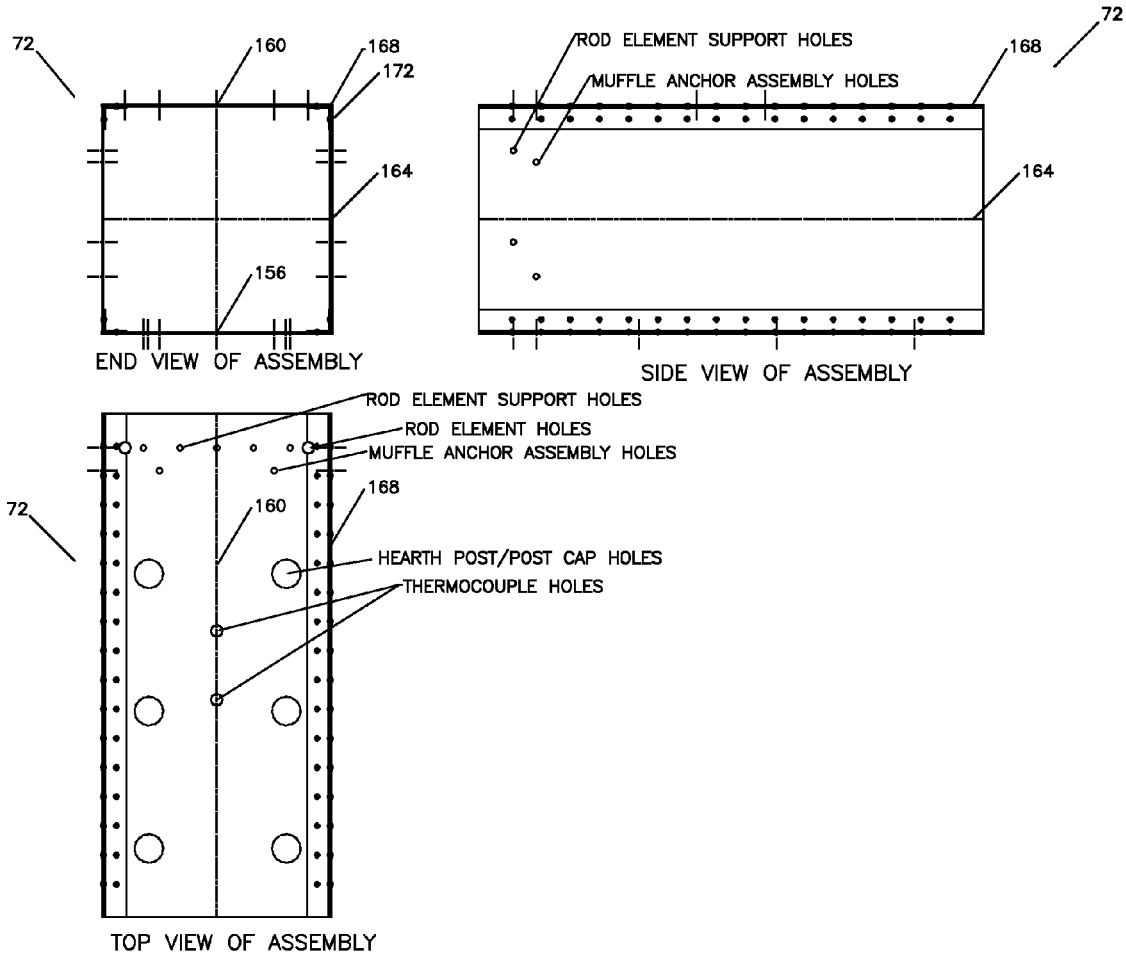
FIG. 26. is a horizontal generally longer muffle assembly, three views, useable with the generally horizontal furnace of FIG. 4
Figure 27:
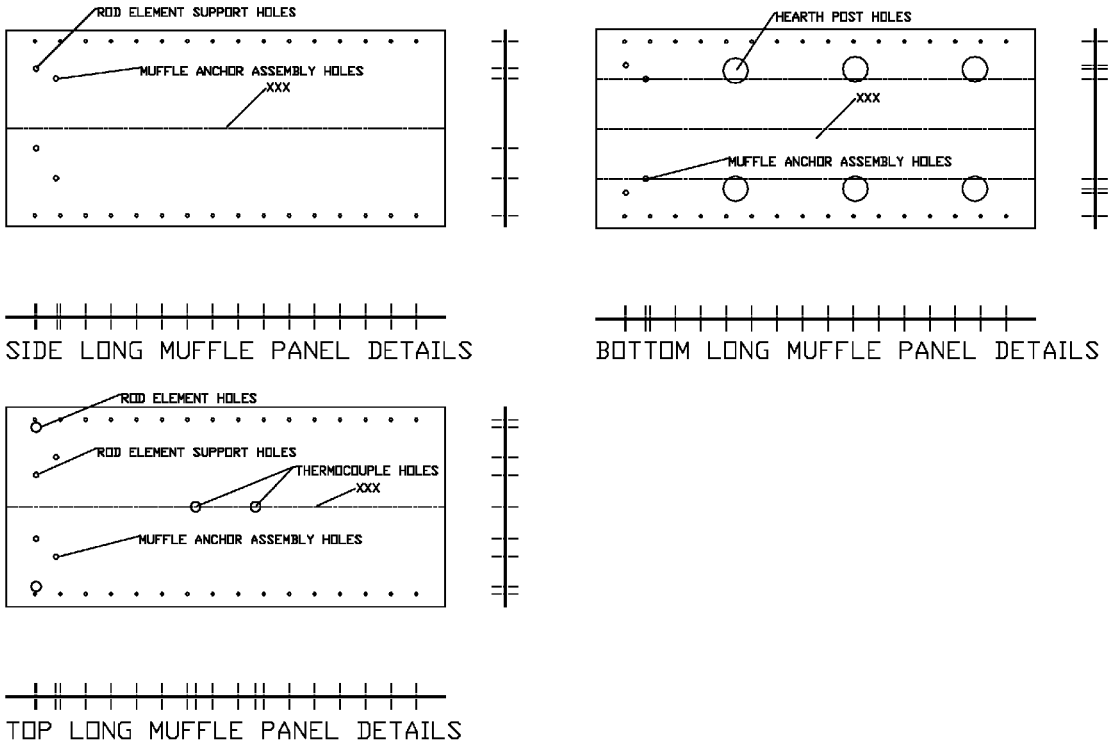
FIG. 27. shows a horizontal generally longer muffle assembly details useable with the generally horizontal furnace of FIG. 4
Figure 28:
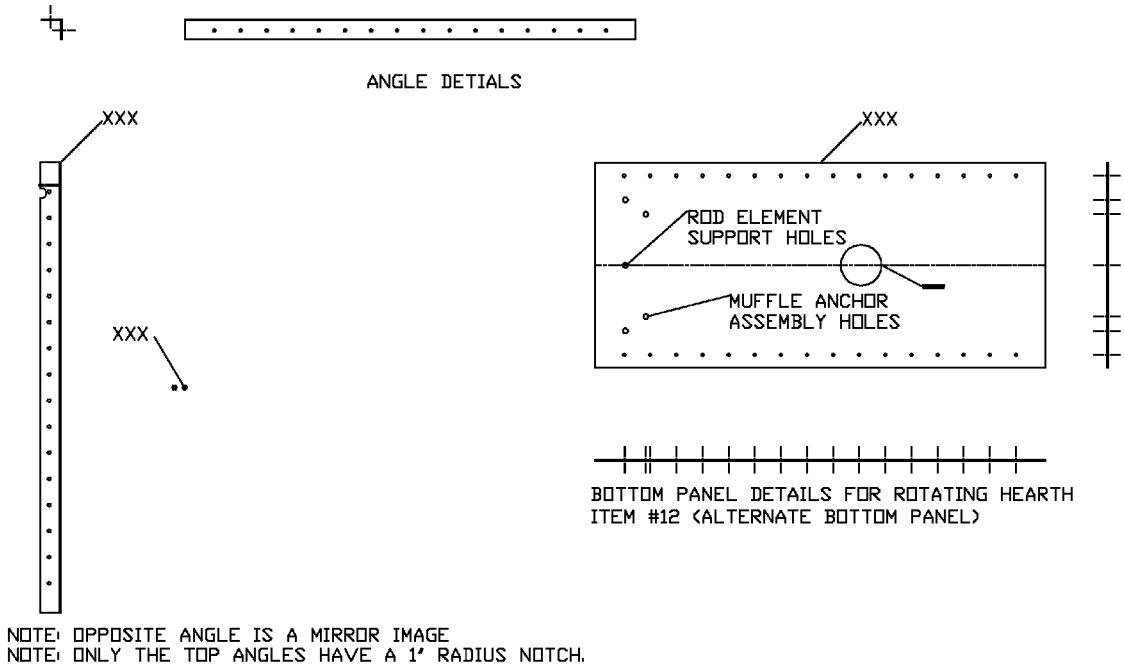
FIG. 28. shows horizontal generally longer muffle assembly details useable with the generally horizontal furnace of FIG. 9

A muffle 72 is shown. The terms "muffle" and/or "muffle assembly" are understood in include any suitable structure(s) and/or means to substantially wrap up, conceal, protect, and/or envelop something, such as for example a load. The illustrated muffle 72 may be a carbon fiber composite muffle and/or substantially comprised of carbon fiber. A plurality of muffle support bars 76, specifically eight to nine, may be provided to support the muffle 72, though any suitable number may be employed. The muffle 72 may be made, shown or used in any suitable number of ways. For purposes of clarity, consistency, and ease of reference, the muffle may be referred to with reference number 72 even though multiple embodiments may be employed. For example, the horizontal generally shorter muffle (shown generally in FIGS. 24 and 25) and the horizontal generally longer muffle (shown generally in FIGS. 26, 27 and 28) may both be referenced with reference number 72, though the horizontal generally shorter muffle and horizontal generally longer muffle may not necessarily be exactly identical to each other.

Carbon fiber, and carbon fiber composite, may be used to refer to carbon filament thread, or to felt or woven material(s) made from such carbon filaments. By extension, these terms may also be used to refer to any composite material made substantially with carbon filament. A carbon fiber composite may or may not employ one or more resins. A carbon fiber composite may or may not be impregnated with a desirable additive. These filaments may be stranded into thread. This thread can then be used to weave a carbon fiber cloth. The appearance of this cloth generally depends on the size of thread and the weave chosen.

Figure 19:
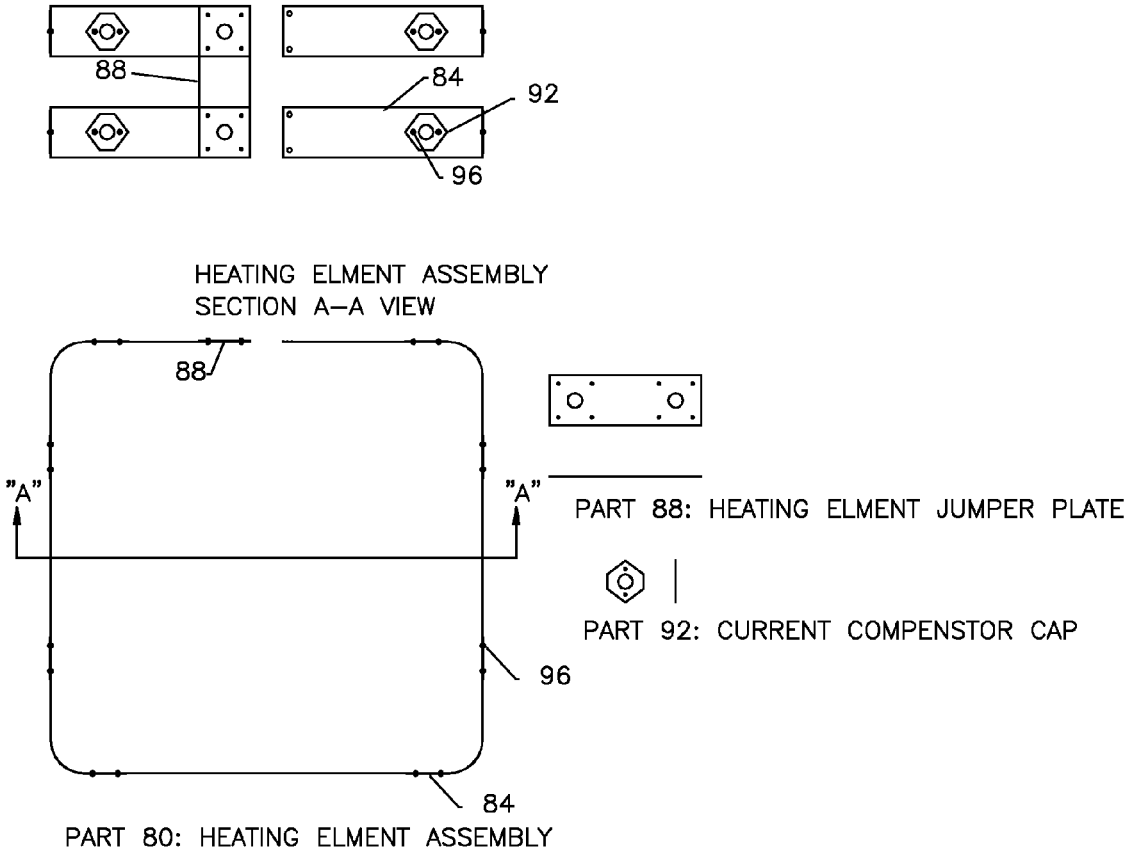

A plurality of heating element assemblies 80, specifically six, are provided as heat producing means. The heating element assemblies 80, seen in detail in FIG. 19, are means for heating a fluid. Each of the heating element assemblies 80 shown include a heating element 84. The illustrated heating element 84 is a generally quadrilateral member with generally rounded corners. The heating element 84 may be supplied with suitable heating element jumper plate 88, current compensator cap 92 and rivets 96 as required.

Figure 15:
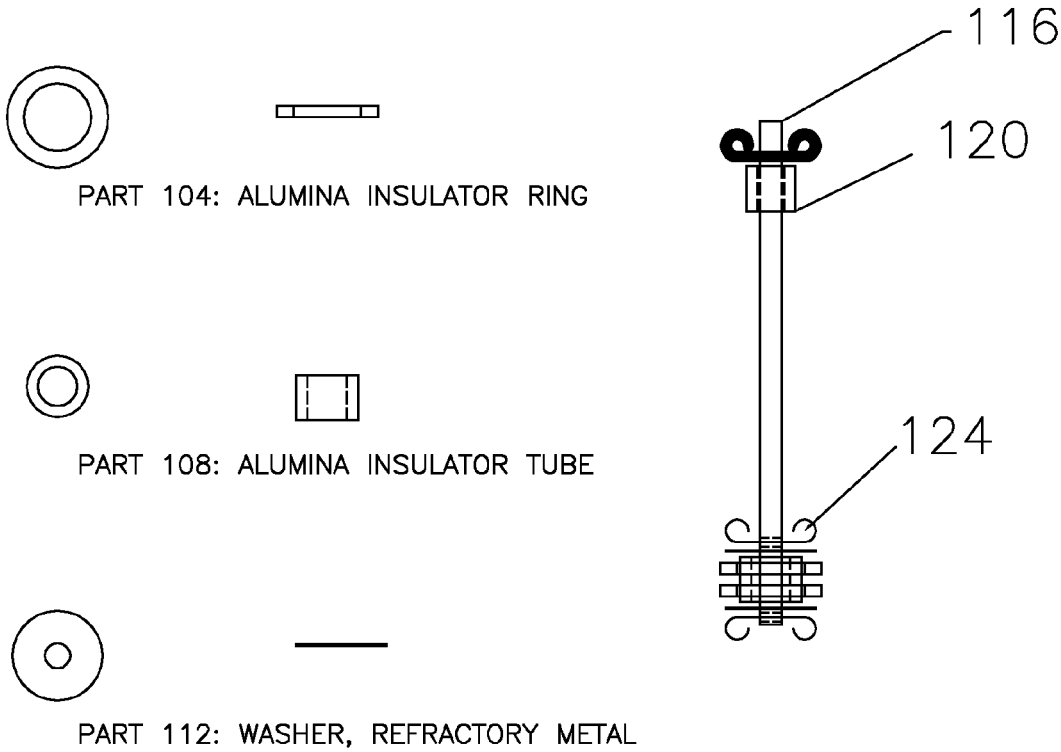
Figure 16:
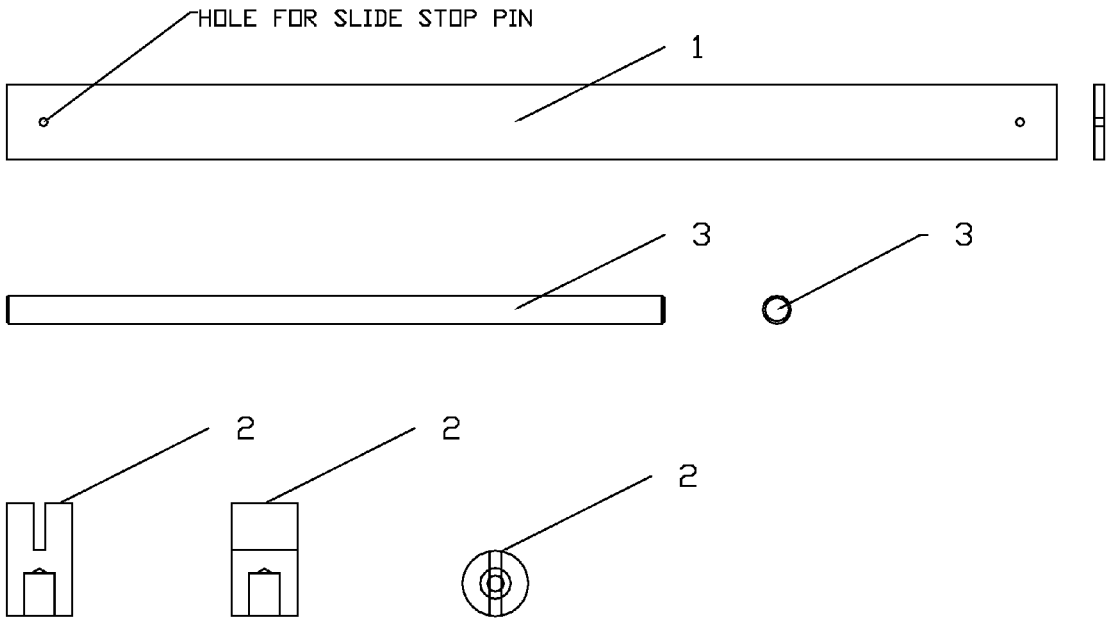

Each heating element assembly 80 is shown operatively connected with a heating element support assembly 100, seen in detail in FIG. 15. The term "operatively connected" is understood to include a linking together of the portions under consideration and may include a physical engagement and/or a functional or operational connection. The illustrated heating element support assembly 100 includes a ceramic ring outer insulator 104 and a ceramic tube inner insulator 108. The ceramic ring outer insulator 104 and the ceramic tube inner insulator 108 may be a high purity alumina or other suitable material. The illustrated heating element support assembly 100 further includes a washer 112 and a generally smooth rod 116. The illustrated washer 112 and the rod 116 may be constructed with a refractory metal or other suitable material. The illustrated heating element support assembly 100 further includes a schedule 80 pipe section 120, which may be constructed with stainless steel or other suitable material, and a wire loop 124 which may be constructed with a refractory metal or other suitable material.

Figure 17:
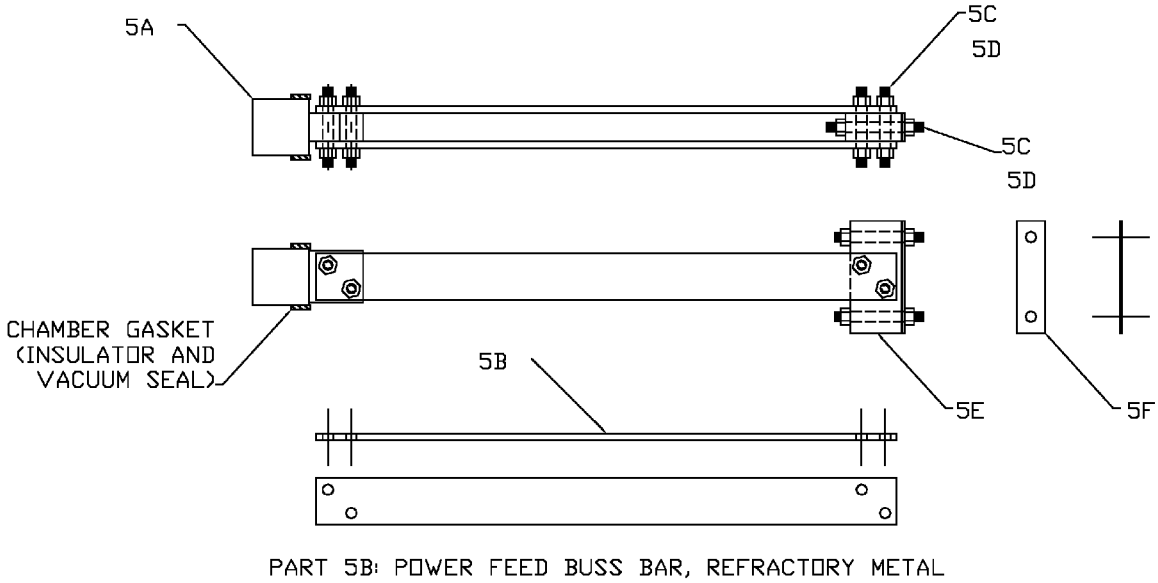
Figure 18:
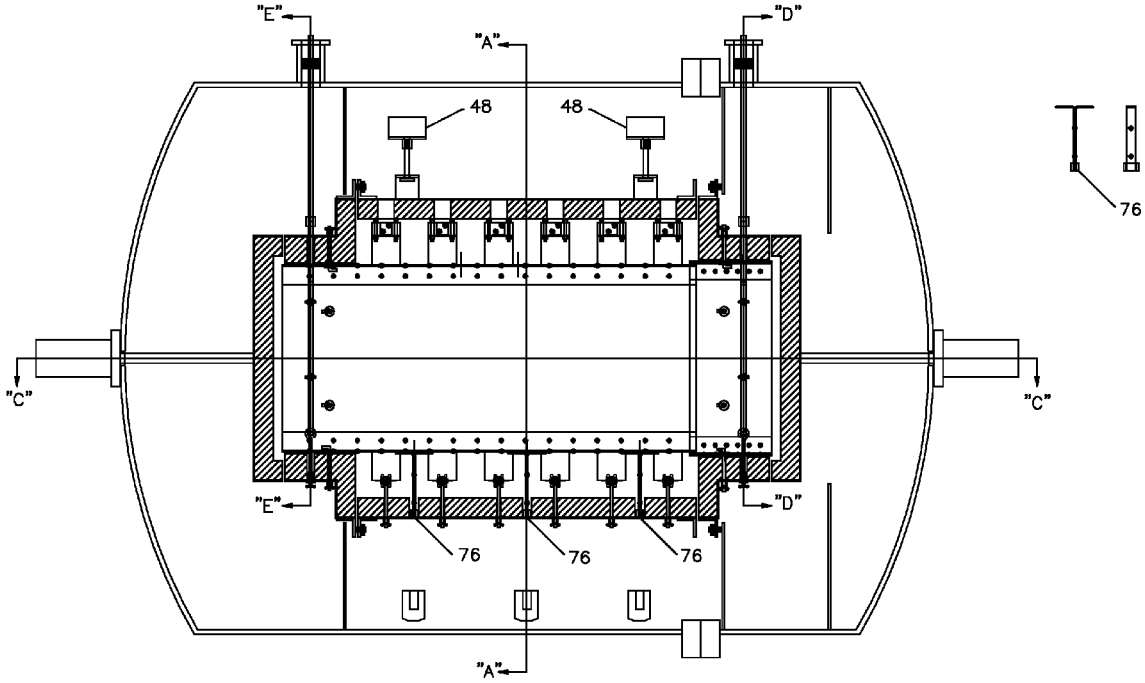

Each heating element assembly 80 is also shown operatively connected with an element power feed assembly 128, seen in detail in FIG. 17. The illustrated element power feed assembly 128 includes a chamber power feed lug 132 which may be constructed with copper or other suitable material and a power feed bus bar 136 which may be constructed with a refractory metal or other suitable material. The illustrated element power feed assembly 128 also includes a suitable number of studs 140 and hex nuts 144, both of which may be constructed with a refractory metal or other suitable material. The illustrated element power feed assembly 128 also includes a suitable power feed terminal block 148 and element tie strap 152, both of which may be constructed with a refractory metal or other suitable material.

The illustrated muffle 72, may be constructed with a carbon fiber or other suitable material. The illustrated muffle 72 includes a muffle bottom panel 156 and a muffle top panel 160. The illustrated muffle 72 also includes a muffle side panel 164 and muffle support 168. The muffle support 168 may be positioned at a corner or any suitable location on the muffle 72. A suitable number and type of rivets 172 may be employed as shown or otherwise. It will be noted that the muffle 72 may include a suitable number of holes and/or openings to accommodate rod elements, rod element supports, muffle anchor assemblies, turntable components and the like. FIGS. 24, 25, 26, 27, and 28 show muffle component details, but are not necessarily the only components suitable for muffle embodiments. Similarly, FIGS. 31, 32, 33, and 34 show other muffle component details.

Referring now to the right side of FIG. 3, a hot gas outlet pipe 176 and hot gas outlet pipe flange 180 are provided. Both the left side and the right side of FIG. 3 show a cold gas inlet pipe 184 an a cold gas inlet pipe flange 188. Likewise, the left side and the right side of FIG. 3 show a cold gas manifold 192. The terms "hot gas" and "cold gas" are terms describing temperature in relative terms.

Figure 20:
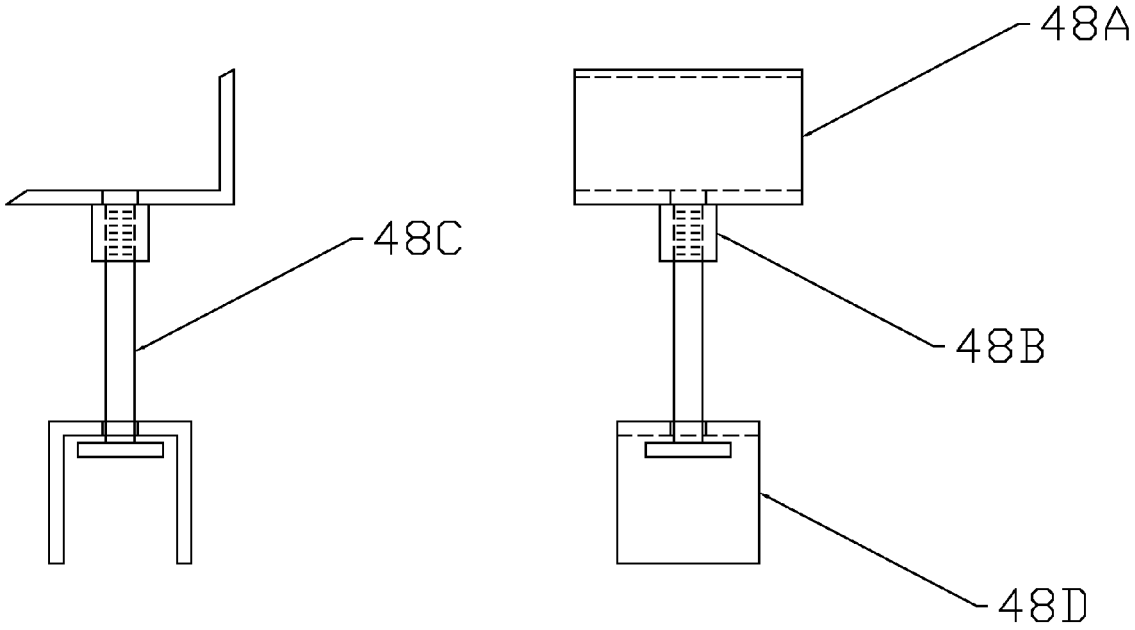
Figure 21:
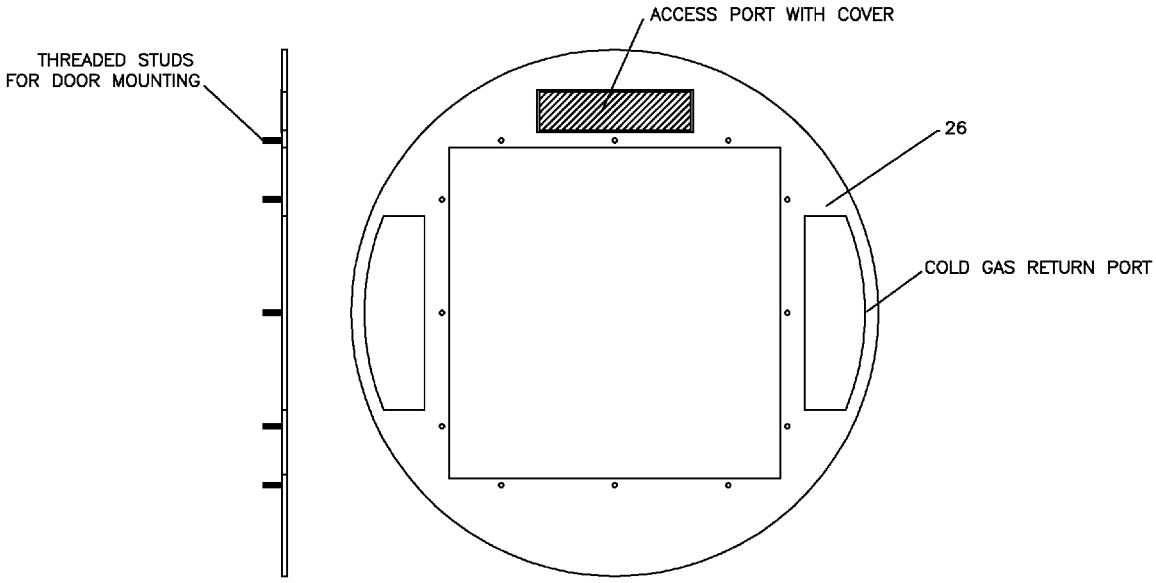
FIG. 21. is a front gas retainer plate (front door)
Figure 22:
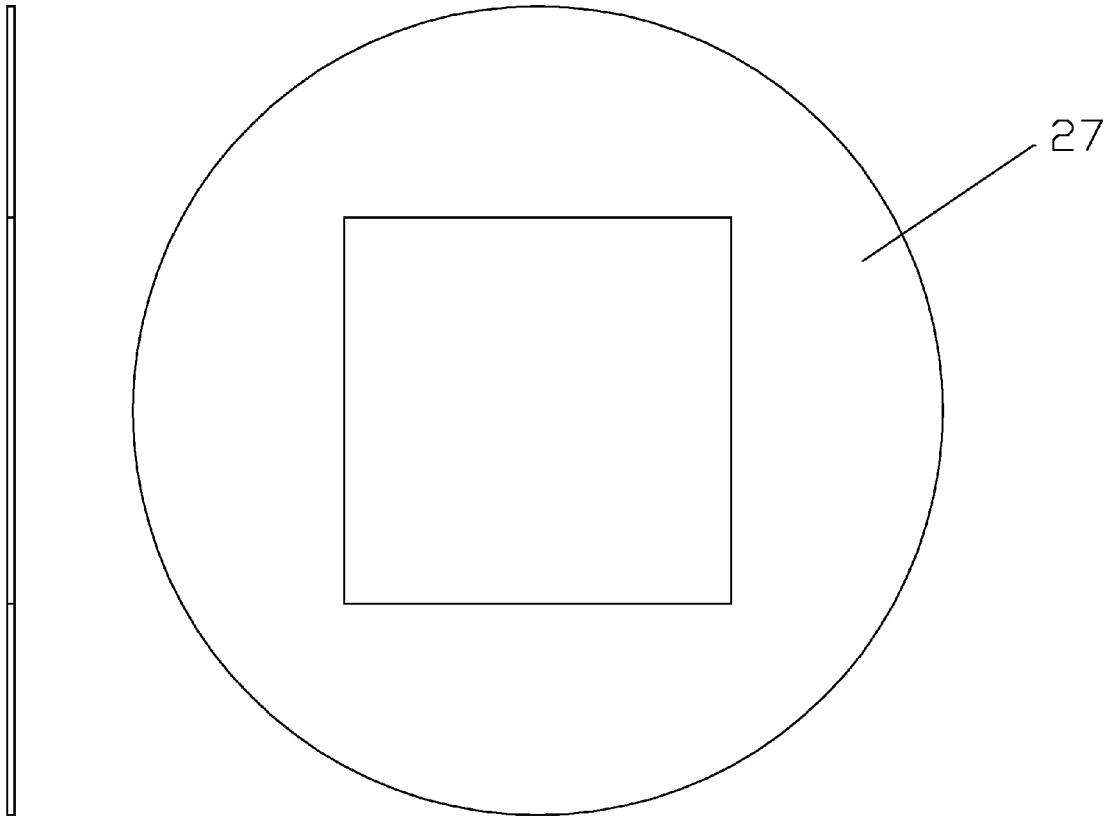
FIG. 22. is a rear gas retainer plate (front door)
Figure 23:
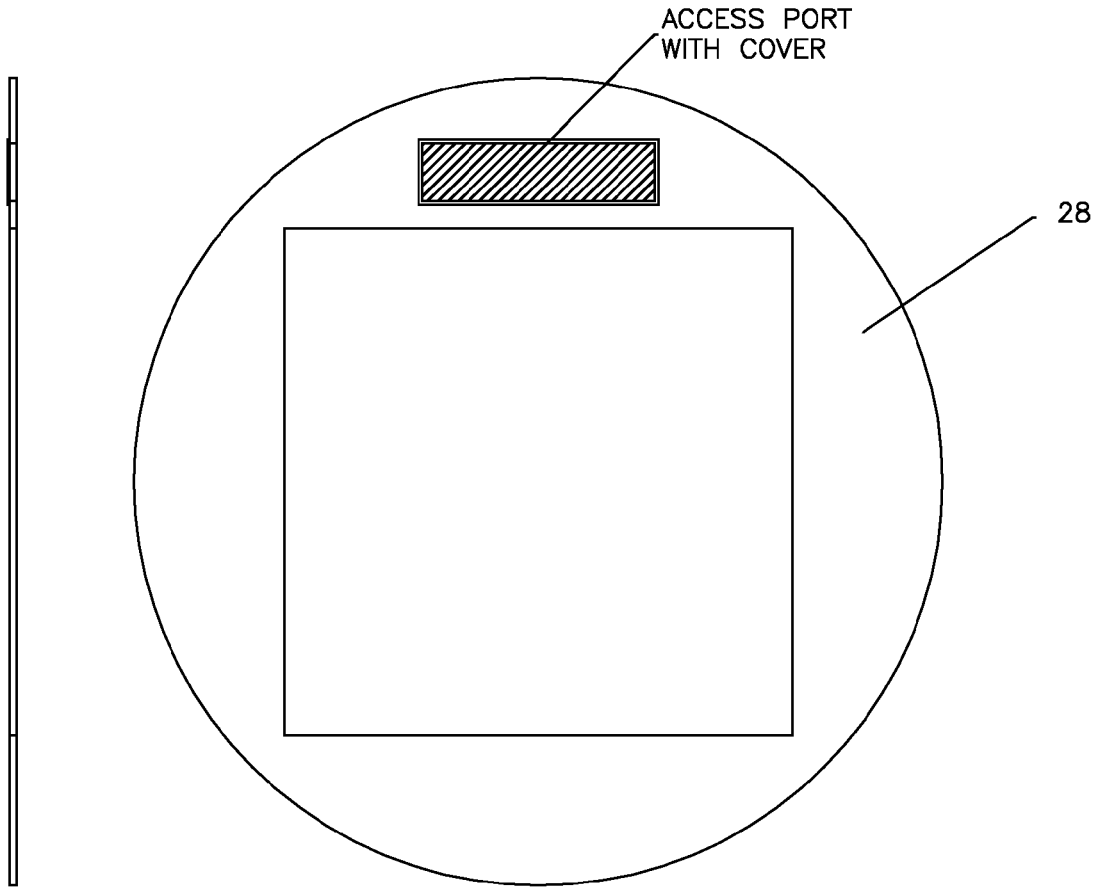
FIG. 23. is a rear gas retainer plate (rear door)

The hot zone shell hanger assembly 48 is seen in detail in FIG. 20. The illustrated hot zone shell hanger assembly 48 includes an angle iron plate 196 and full coupling 200, both of which may be constructed with a suitable steel or other suitable material. A bolt 204 and a u-channel 208 are shown operatively connected to the angle iron plate 196. The bolt 204 and the u-channel 208 may be constructed with a suitable stainless steel or other suitable material.

Figure 4:
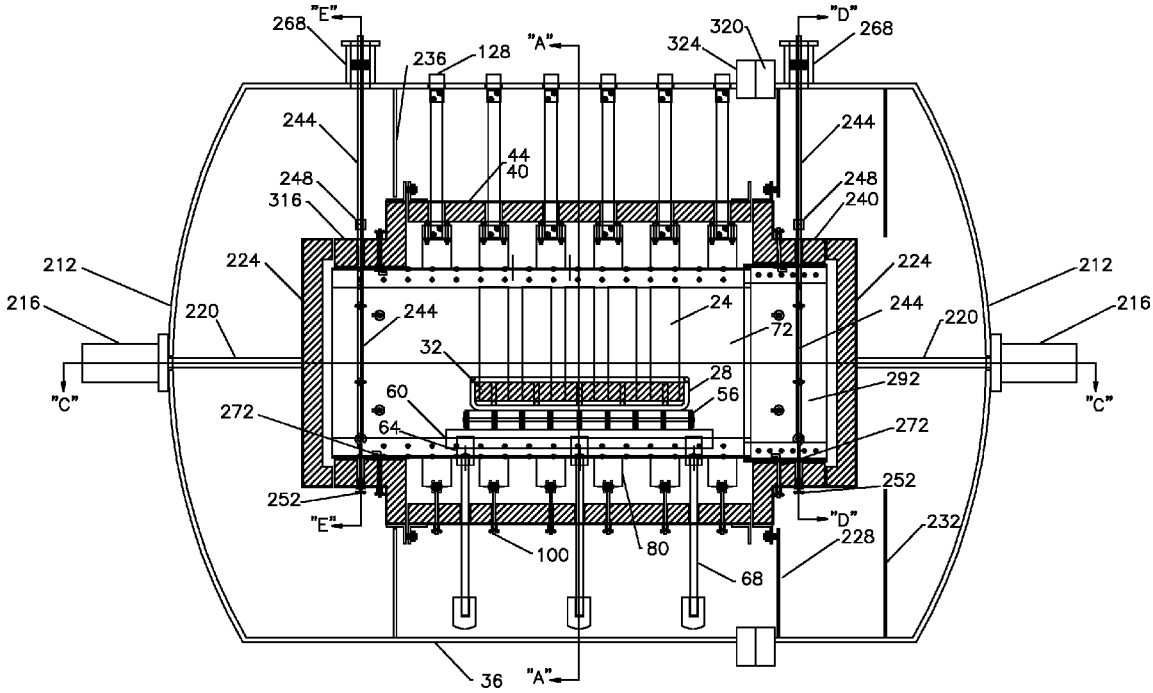
Figure 5:
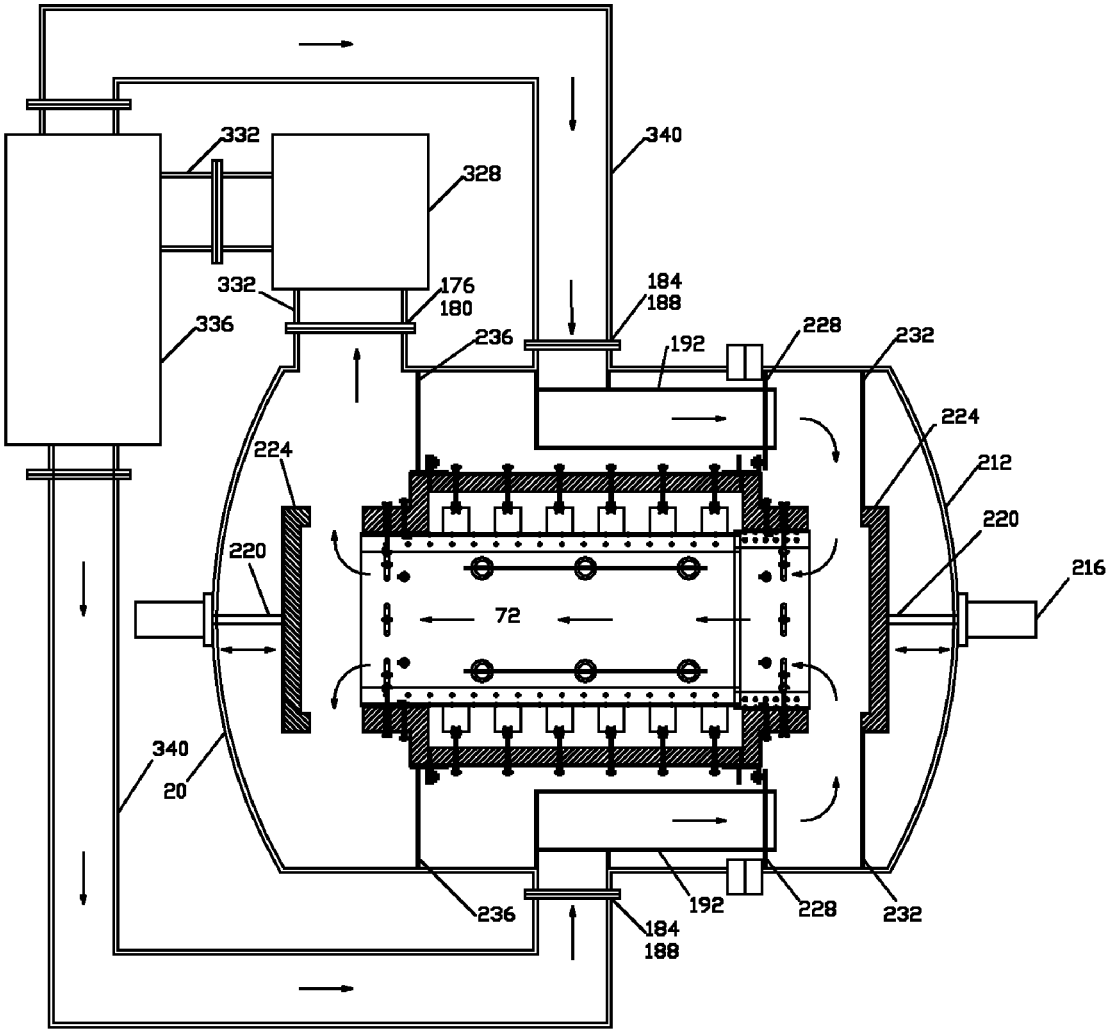

Referring now primarily to FIGS. 4 and 5, the illustrated furnace 20 includes a flanged and dished head 212 on generally opposing sides of the furnace 20, as shown. Both sides of the illustrated furnace 20 feature a double acting cylinder 216. Each double acting cylinder 216 is provided in the vacuum housing. A piston rod 220 is shown operatively connected to the cylinder 216. A pair of muffle end caps 224, which may be insulated, may be provided on opposing ends of the furnace 20, as shown. The piston rod 220 is shown in an extended position with the muffle end cap 224 in a relatively closed position in FIG. 4. The piston rod 220 is shown in a retracted position with the muffle end cap 224 in a relatively opened position in FIG. 5, thus showing a cooling mode position. The term "mode" is understood to include any suitable number and types of manifestations, forms, or arrangements of being.

A front door front gas retainer plate 228 is shown to the right side for the furnace 20. A front door rear gas retainer plate 232 is shown adjacent to the muffle end cap 224 to the right side for the furnace 20. A rear door gas retainer plate 236 is shown to the left side of the furnace to facilitate gas flow as shown. A front door 240 is shown in substantial contact with the muffle end cap 224 to the right side for the furnace 20 in FIG. 4. A rear door 316 is shown in substantial contact with the muffle end cap 224 to the left side for the furnace 20 in FIG. 4. A rod heating element 244 and a rod heating element coupling 248 are provided at the front door 240 and a rear door 316. The rod heating element 244 and rod heating element 248 coupling may be constructed with a refractory metal or other suitable material.

Figure 30:
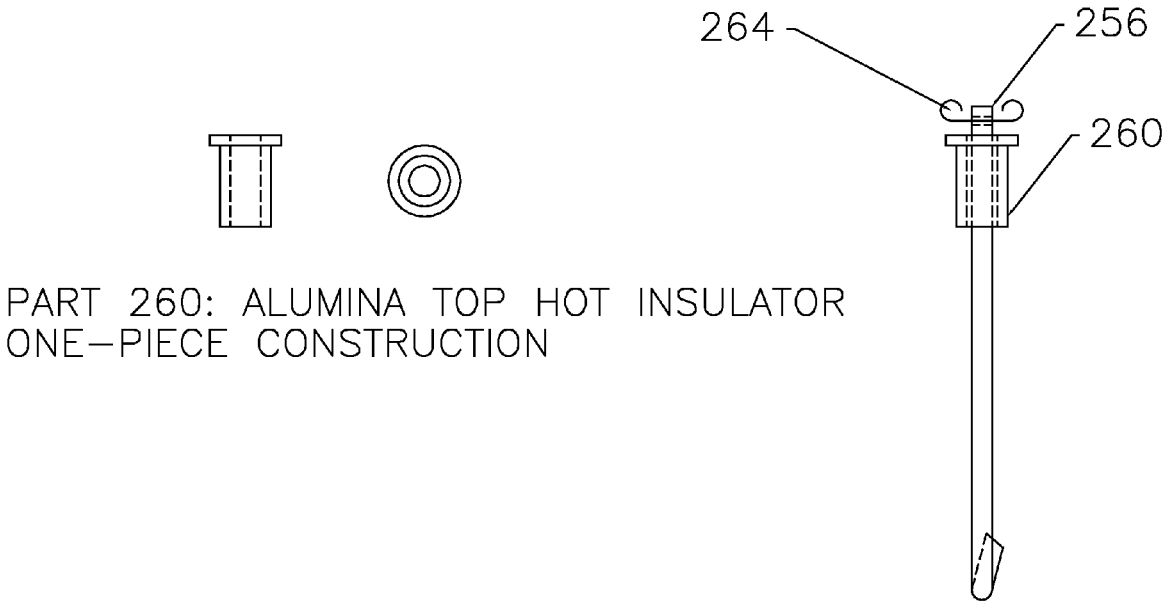
FIG. 30. is a rod element support assembly
Figure 31:
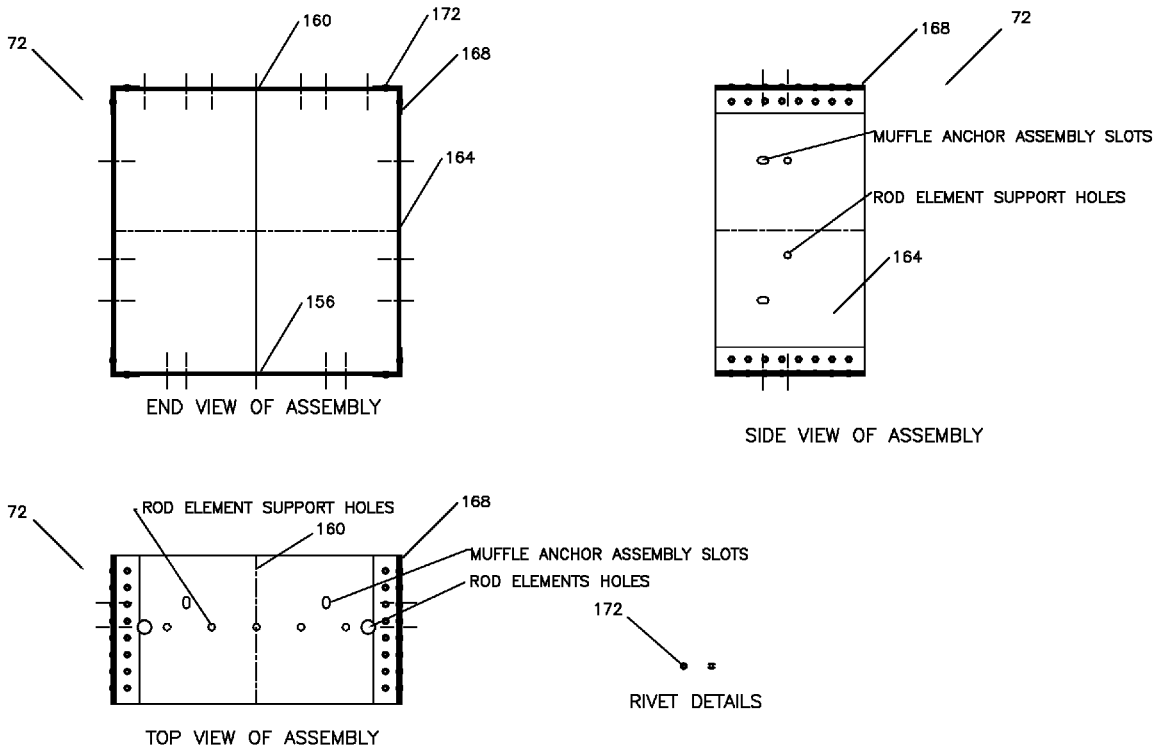
FIG. 31. is a vertical generally shorter muffle assembly useable with the generally vertical furnace of FIG. 10
Figure 32:
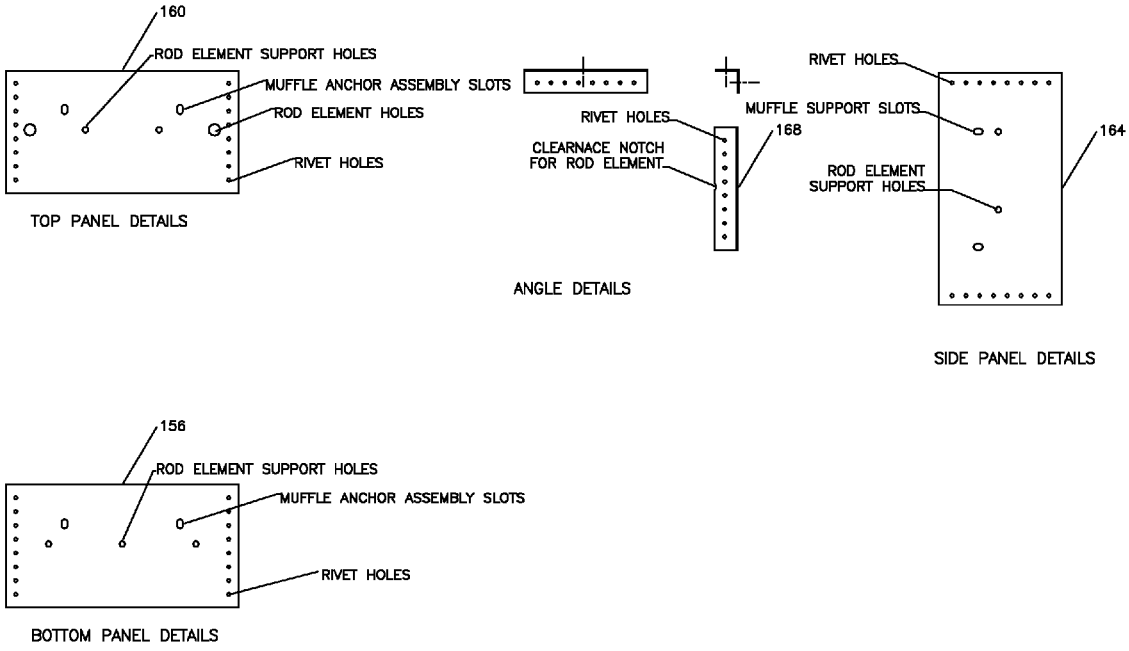
FIG. 32. shows a vertical generally shorter muffle assembly details useable with the generally vertical furnace of FIG. 10
Figure 33:
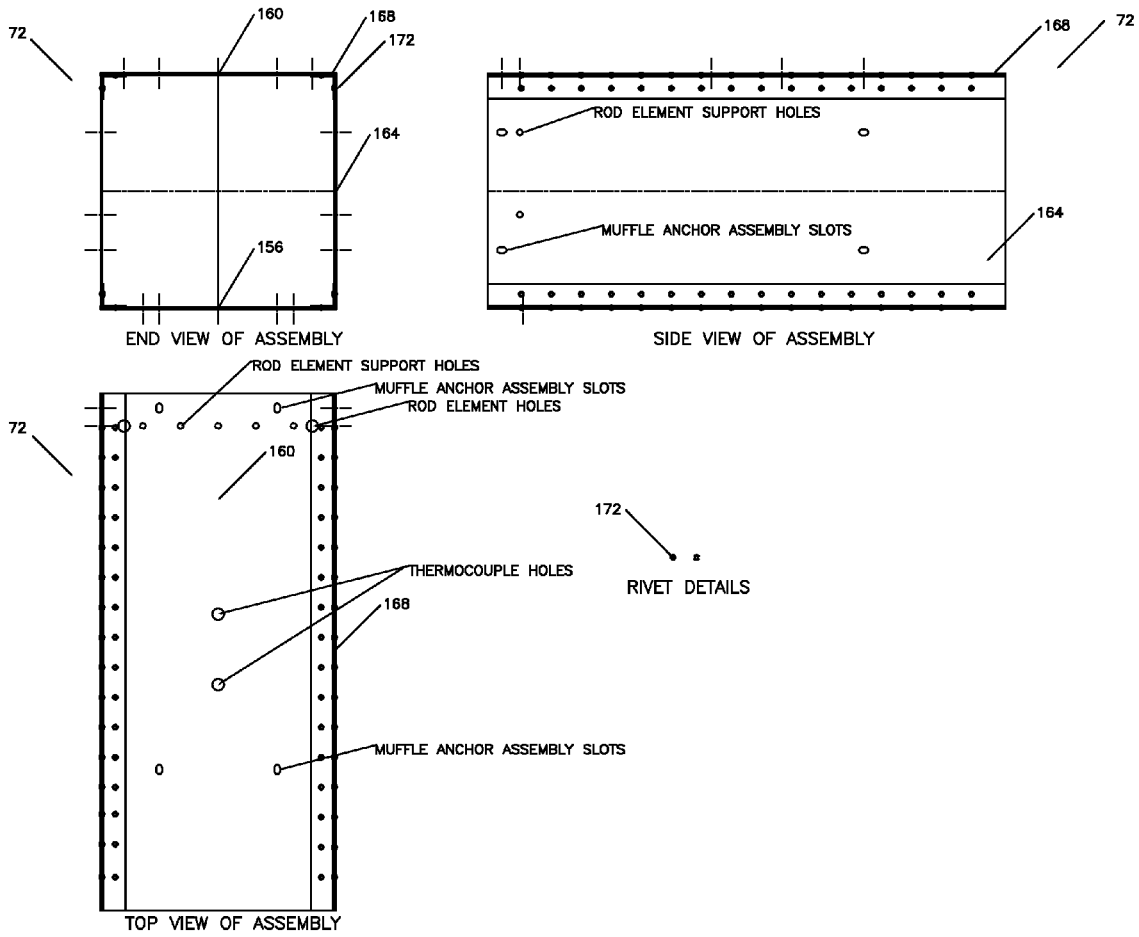
FIG. 33. is a vertical generally longer muffle assembly
Figure 34:
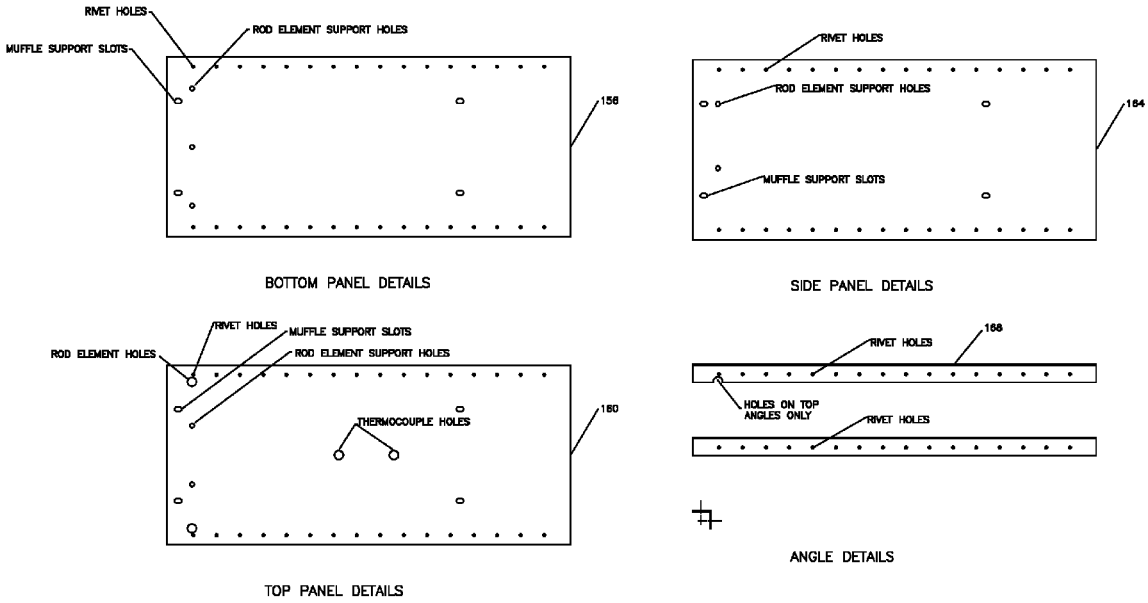
FIG. 34. shows a vertical generally longer muffle details

A rod element support assembly 252, seen also in FIG. 30, is also shown at the front door 240 and the rear door 316. The illustrated rod element support assembly 252 includes an element j-hook retainer rod 256 which may be constructed with a refractory metal or other suitable material. A top hat insulator 260 and wire loop 264 are operatively connected to the element j-hook retainer rod 256. The wire loop 264 may be constructed with a refractory metal or other suitable material. The top hat insulator 260 may be constructed with a high purity alumina or other suitable material.

Figure 29:
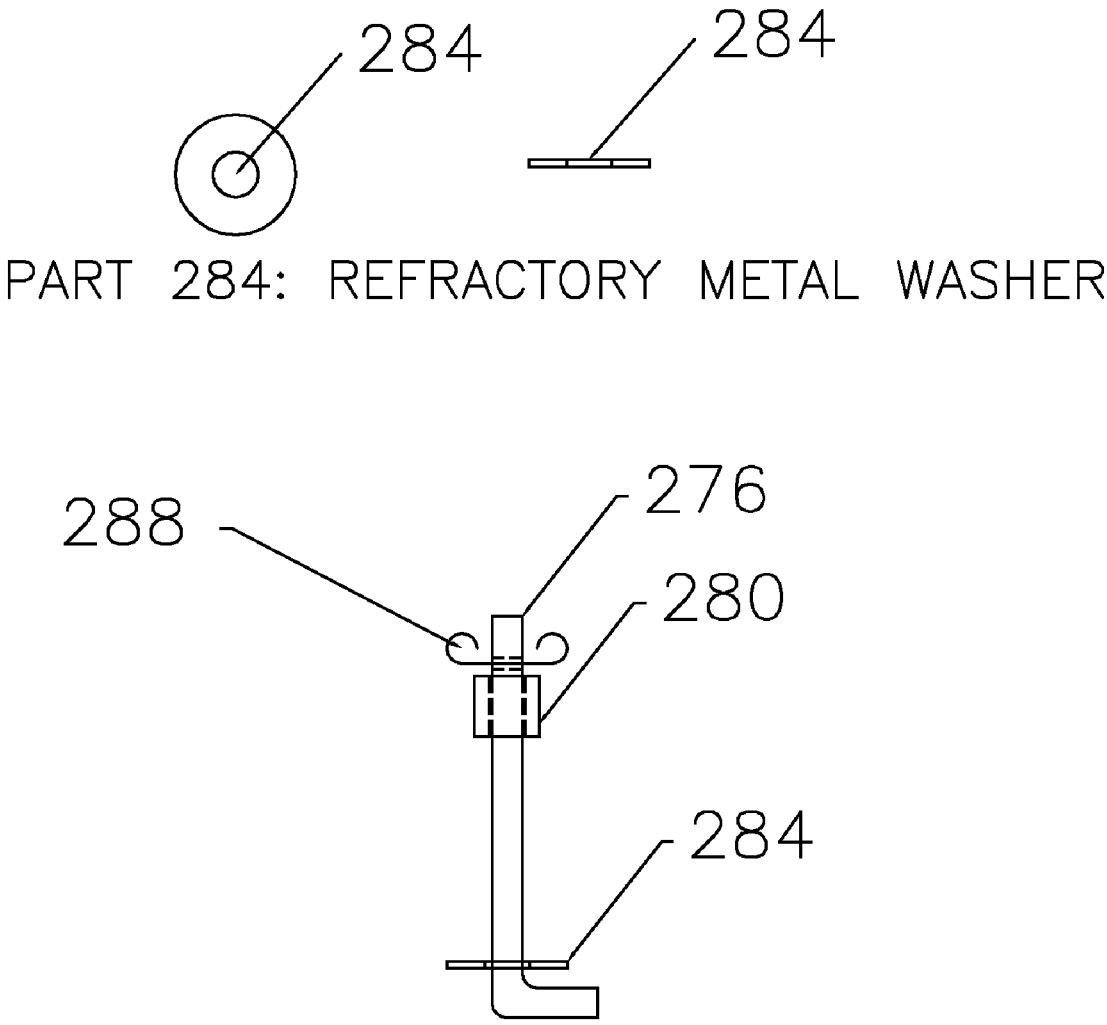
FIG. 29. is a horizontal muffle anchor assembly useable with the generally horizontal furnace of FIG. 4

A rod element power feed port 268 is also provided for the front door 240 and the rear door 316. A muffle anchor assembly 272 is also positioned proximate the front door 240 and the rear door 316. The illustrated muffle anchor assembly 272 includes a muffle anchor rod 276 which may be constructed with a refractory metal or other suitable material and a schedule 40 pipe section 280 which may be constructed with a stainless steel or other suitable material. The illustrated muffle anchor assembly 272 also includes a washer 284 and a wire loop 288, shown in FIG. 29, which may be constructed with a refractory metal or other suitable material.

Referring now primarily to FIG. 5, the furnace 20 is shown in a cooling mode. The term "cooling mode" is understood to include a particular functioning arrangement or condition that facilitates cooling of the load compared to other modes, such as for example a heating mode. The illustrated invention includes a high temperature fan and motor 328. The high temperature fan and motor 328 are preferably adapted to accommodate extreme temperatures. A hot gas piping 332 is provided in fluid communication with a heat exchanger 336. Any suitable heat exchanger 336 may be employed, though a water cooled shell and tube model may be considered. A cold gas return piping 340 is positioned as shown downstream of the heat exchanger 336. As indicated by the arrows, a suitable fluid moves though the muffle 72, and thus the load in the muffle, to cool the load. It should be noted that the fluid moves in a substantially unidirectional flow within the muffle. The fluid flows in a substantially unidirectional flow through the muffle.

Figure 6:
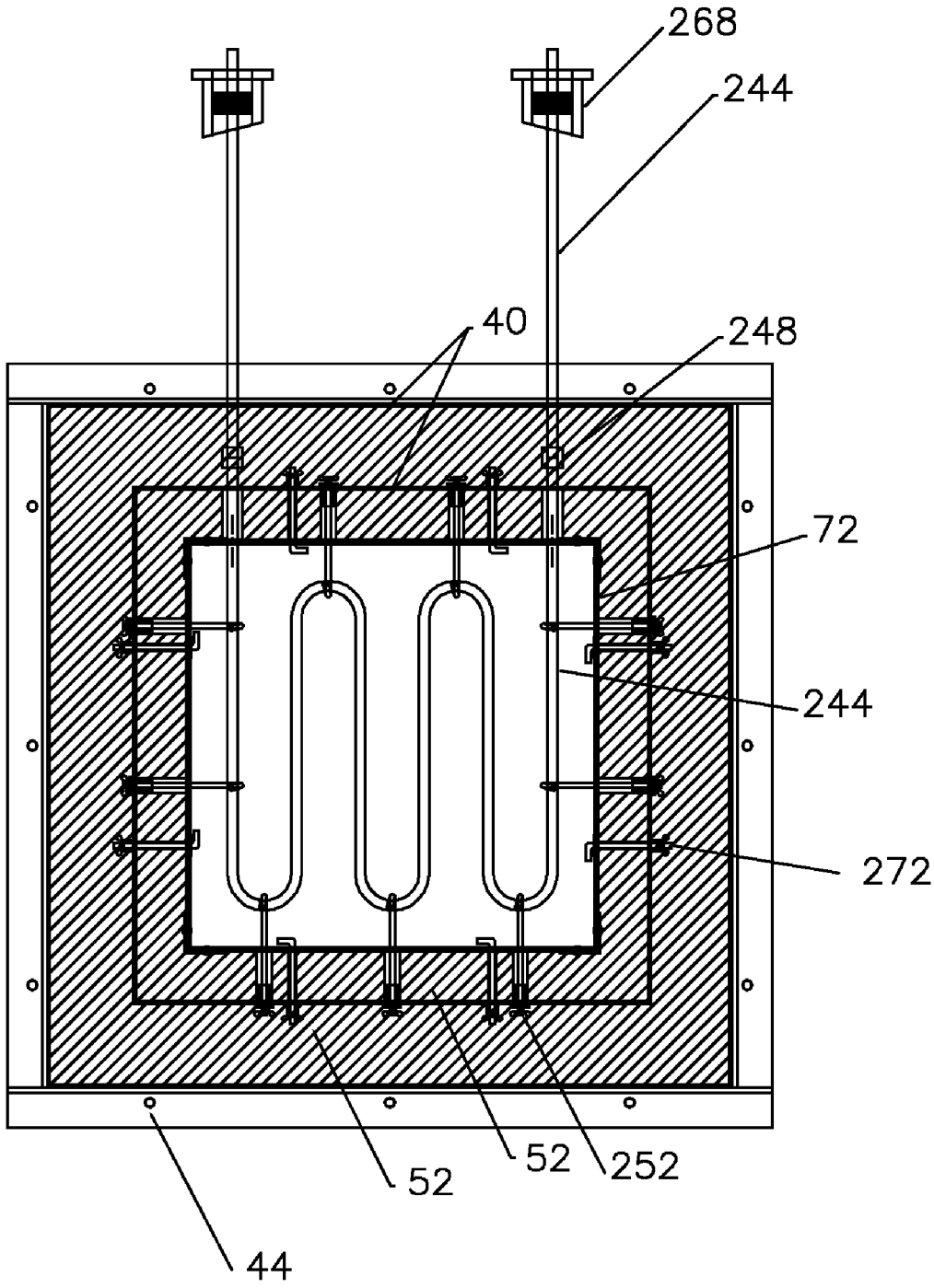
Figure 7:
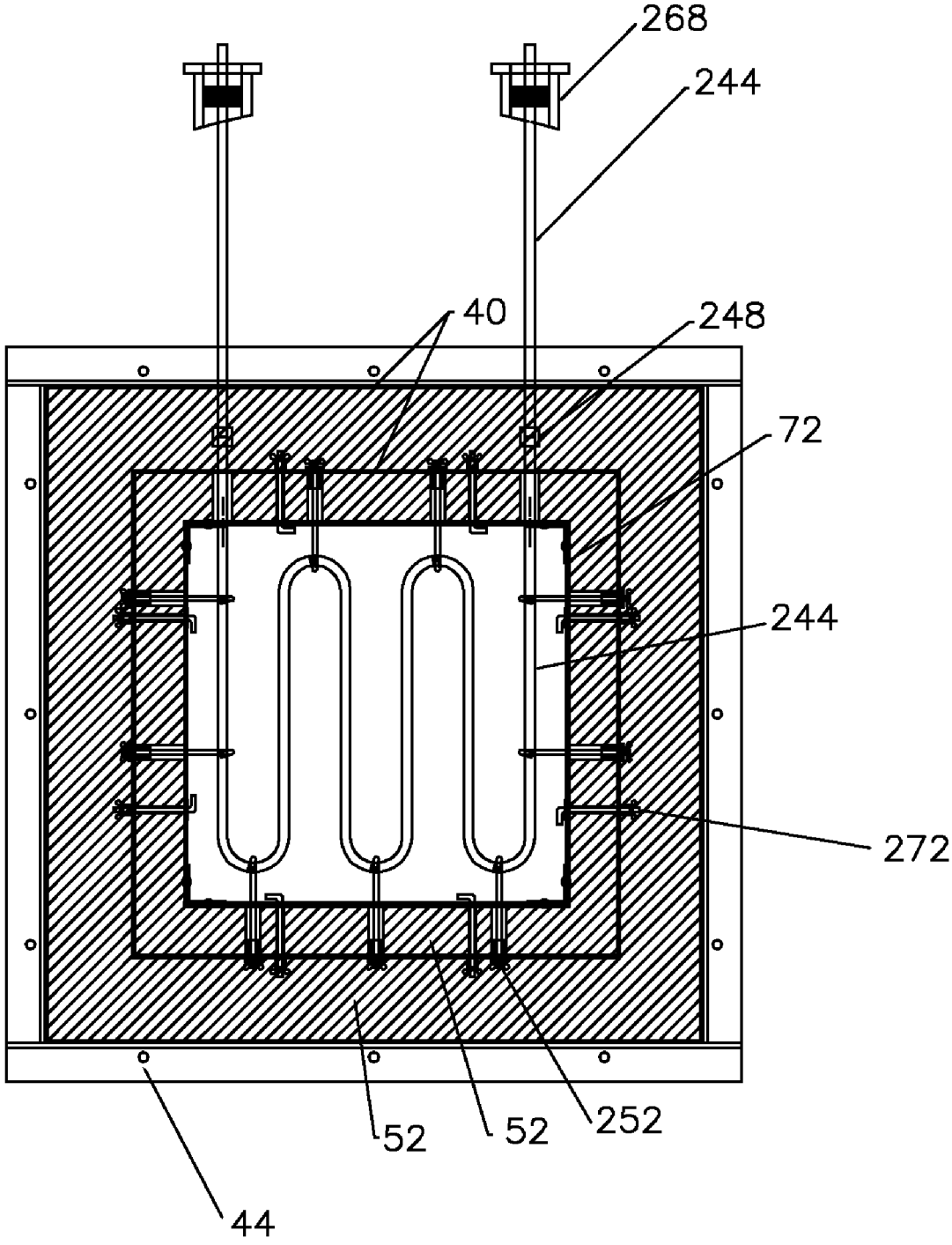

Referring now primarily to FIG. 6, the illustrated front door 240 includes the rod heating element 244 and a rod heating element coupling 248. It should be noted that the rod heating element 244 is a means for heating the fluid. Other means for heating the fluid may be employed and positioned as desired. The illustrated rod heating element 244 is located substantially within at least one end of the muffle.

Figure 8:
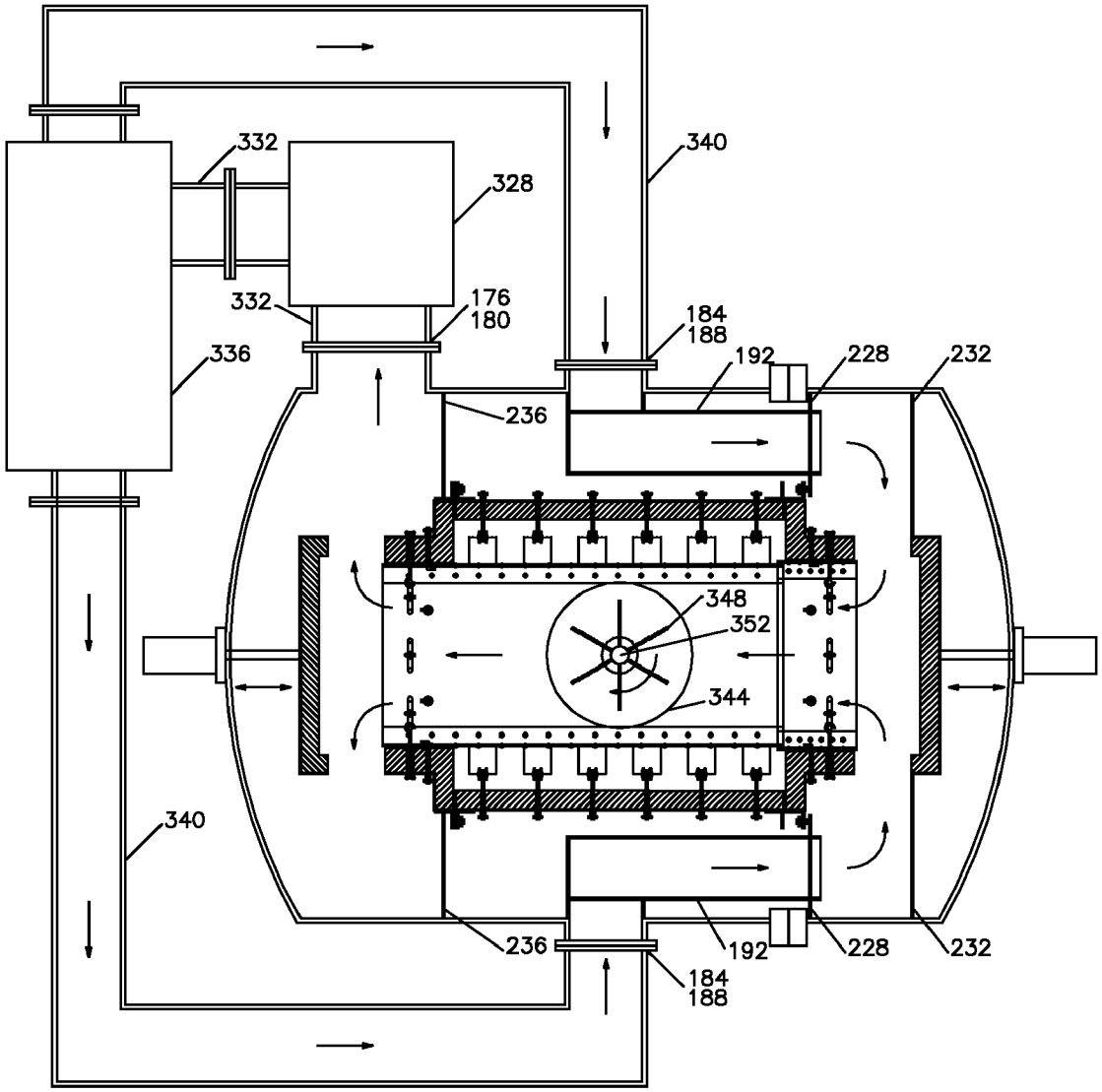

Referring now primarily to FIG. 8, an alternate embodiment is shown. A number or components of the invention shown in FIG. 5 also appear in FIG. 8. FIG. 8 also features a turntable 344. Without wishing to be bound by theory, it is believed that the turntable 344 may reduce the potential for positional heating and/or cooling by rotating the load. The rotation of the turntable 344 better allows the load to be more evenly exposed and/or positioned for heating and/or cooling. A suitable number of type of turntable supports 348 and a turntable shaft 352 may be employed for support and movement of the turntable 344. The turntable 344, turntable supports 348, and turntable shaft 352 may be constructed with a refractory metal or other suitable material.

Figure 9:
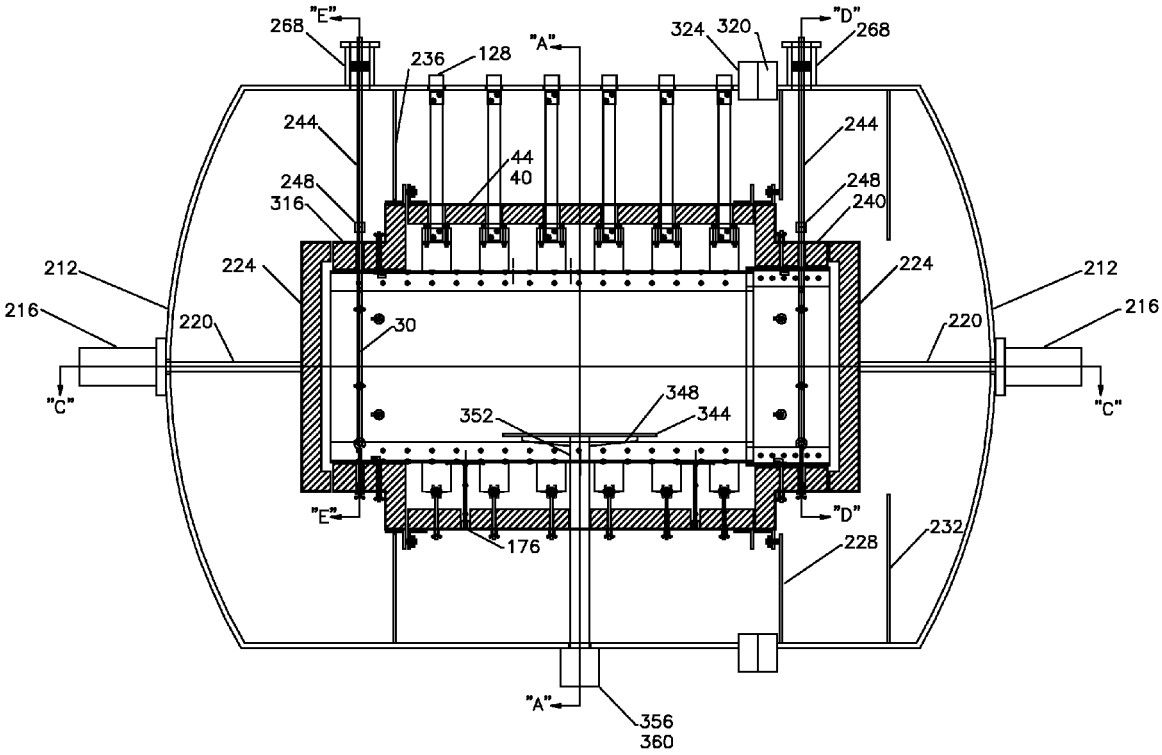

Referring now primarily to FIG. 9, another view of the vacuum furnace with the turntable 344, turntable supports 348, and turntable shaft 352 is provided. A number or components of the invention shown in FIG. 8 also appear in FIG. 9. A variable speed vacuum motor 356 and vacuum housing 360 may be positioned as shown or in any other suitable fashion.

Figure 10:
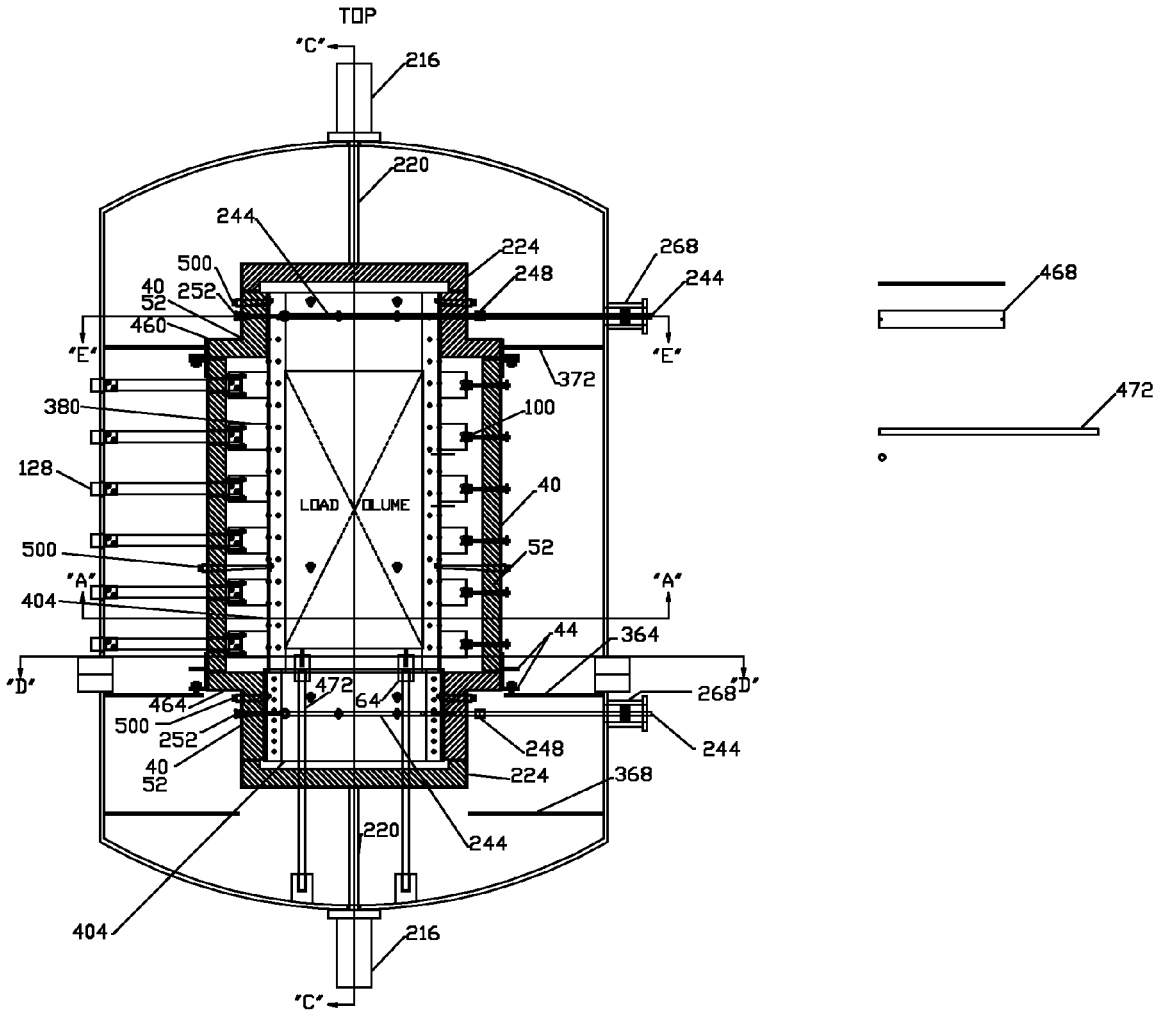
Figure 11:
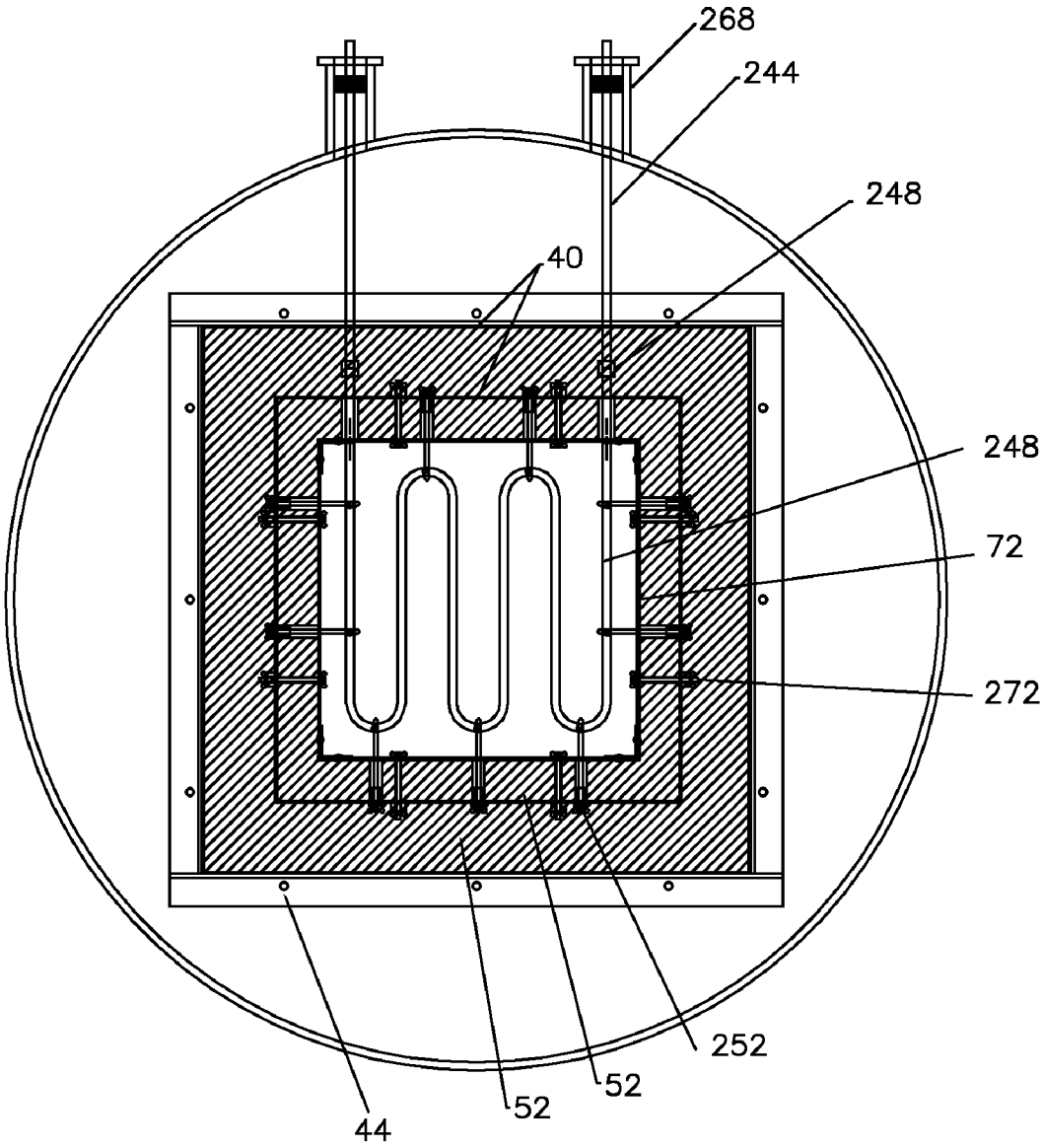
Figure 12:
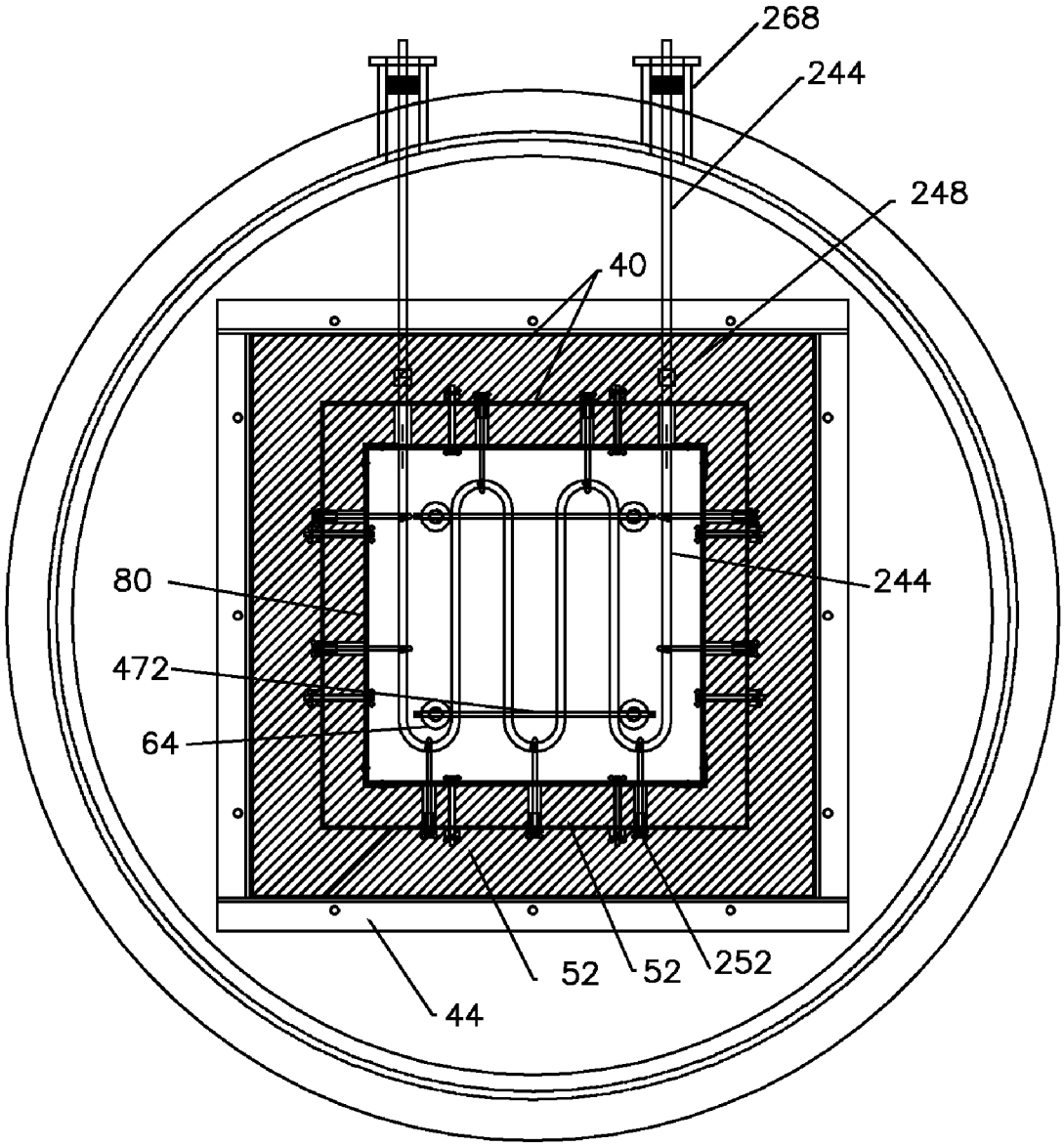
Figure 13:
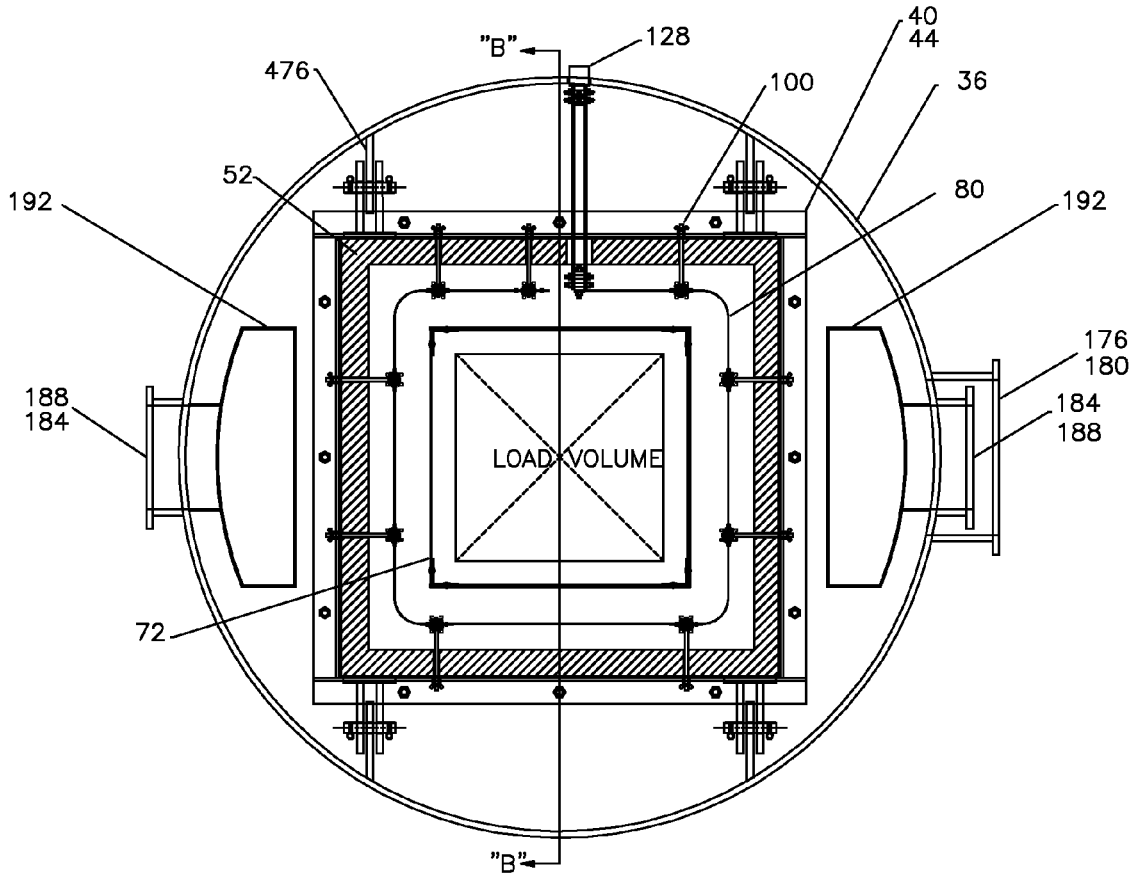
Figure 14:
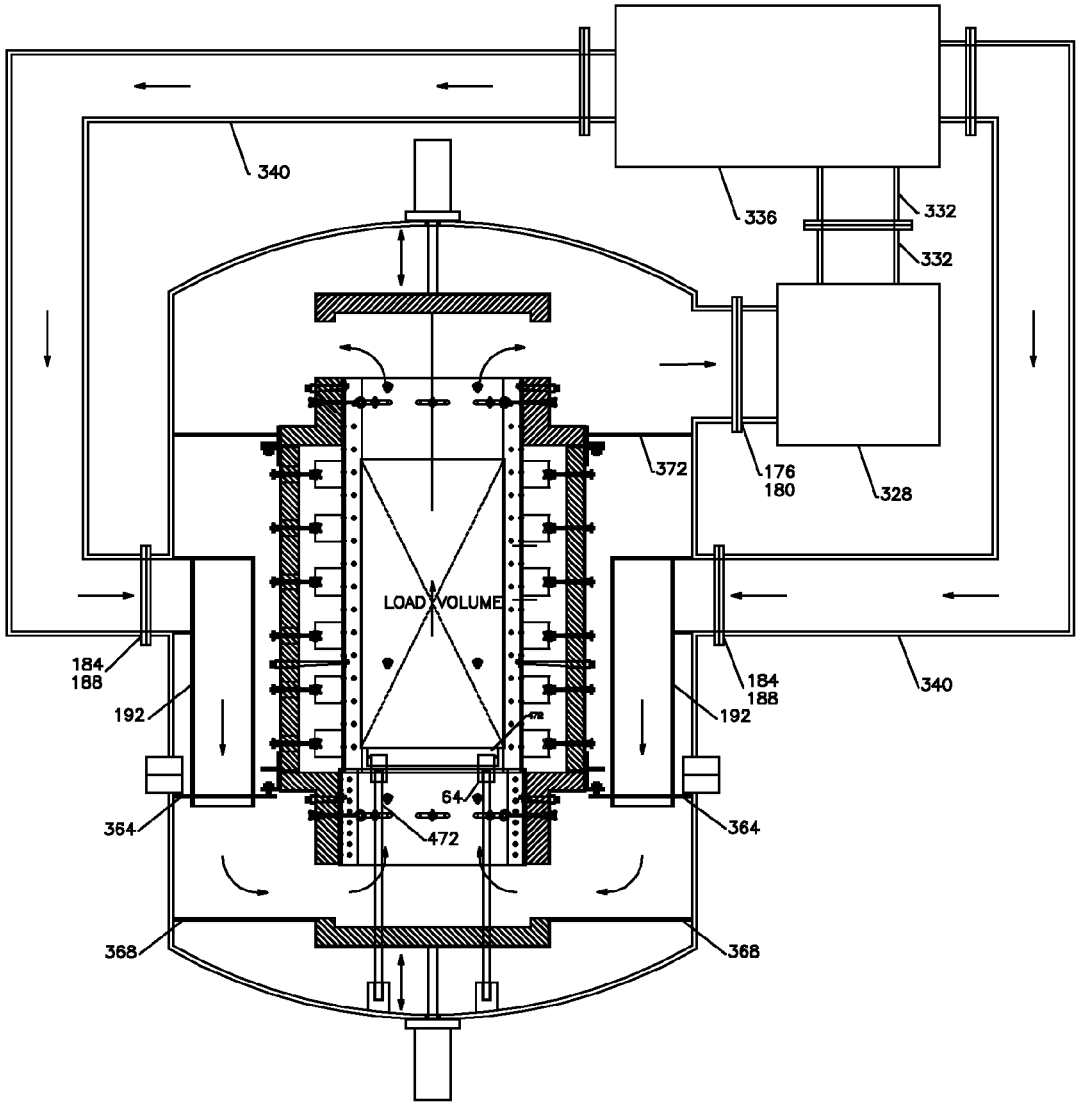

A generally rectangular vertical muffle assembly 404 is shown for the generally vertical vacuum furnace, seen in FIG. 10. A generally rounded vertical muffle assembly 404 is shown for the generally vertical vacuum furnace, seen in FIG. 37.

Figure 37:
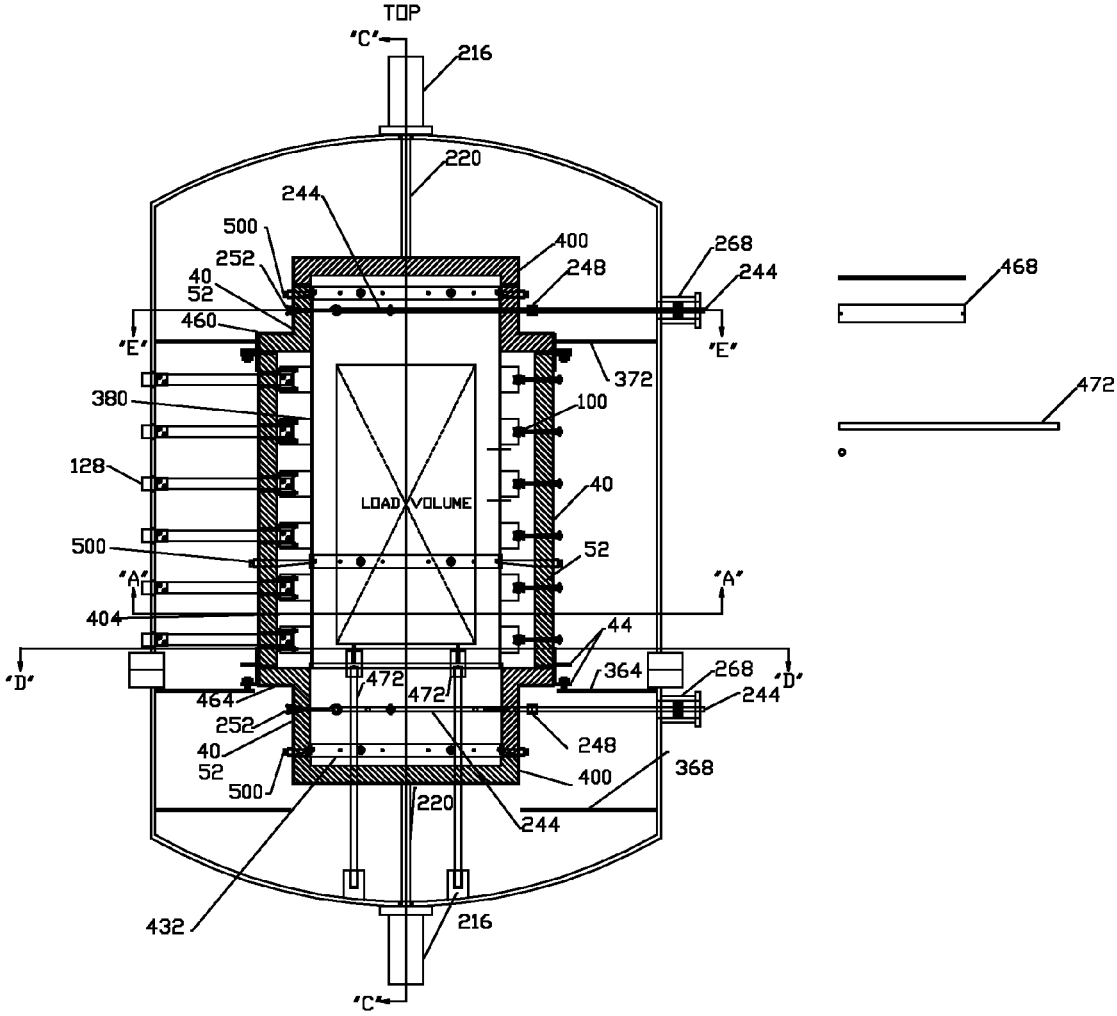
FIG. 37. is a side view of a generally rounded muffle, such as is shown in FIGS. 47-48, in a generally vertical furnace FIG. 38. is a section view of a generally rounded muffle, such as is shown in FIGS. 47-48, in a generally vertical furnace FIG. 39. is a top section view of a round muffle top door in a generally vertical furnace FIG. 40. is a section view of a rounded muffle bottom door in a generally vertical furnace FIG. 41. is a cooling mode in a generally vertical furnace with a generally rounded muffle FIG. 42. is an upper gas retainer plate (bottom door)
Figure 38:
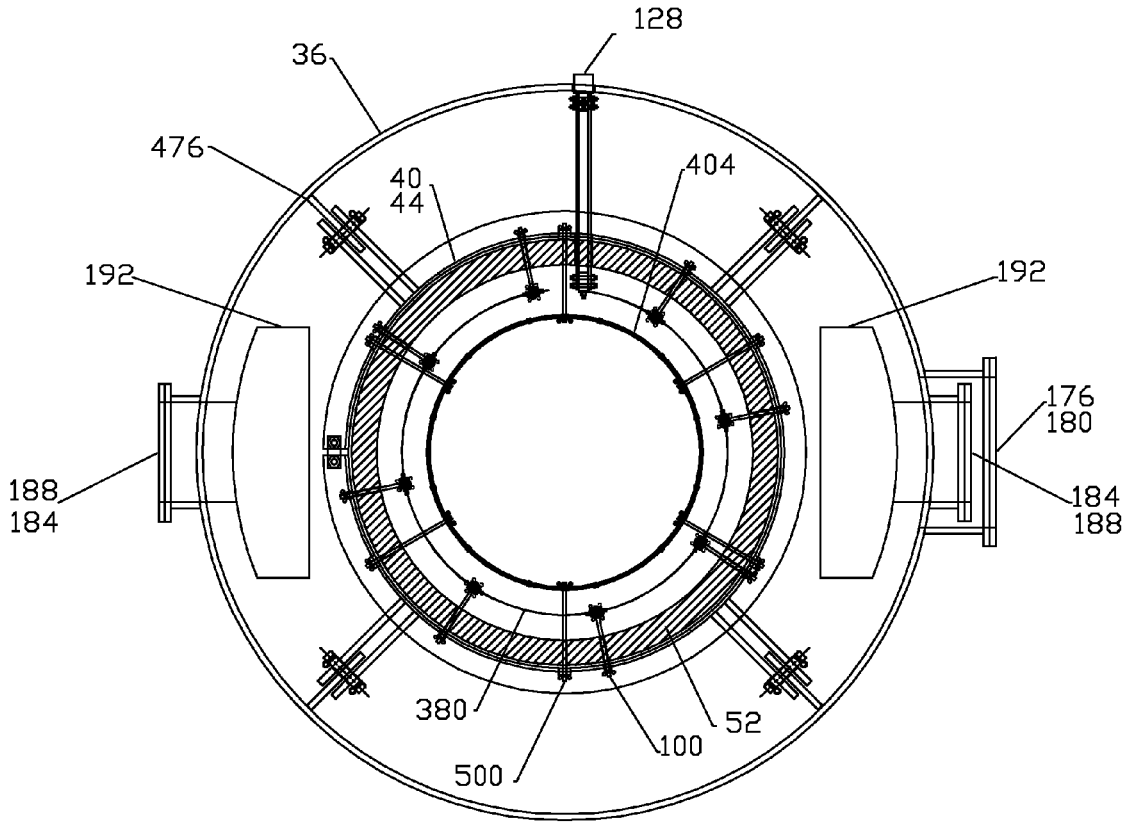
Figure 39:
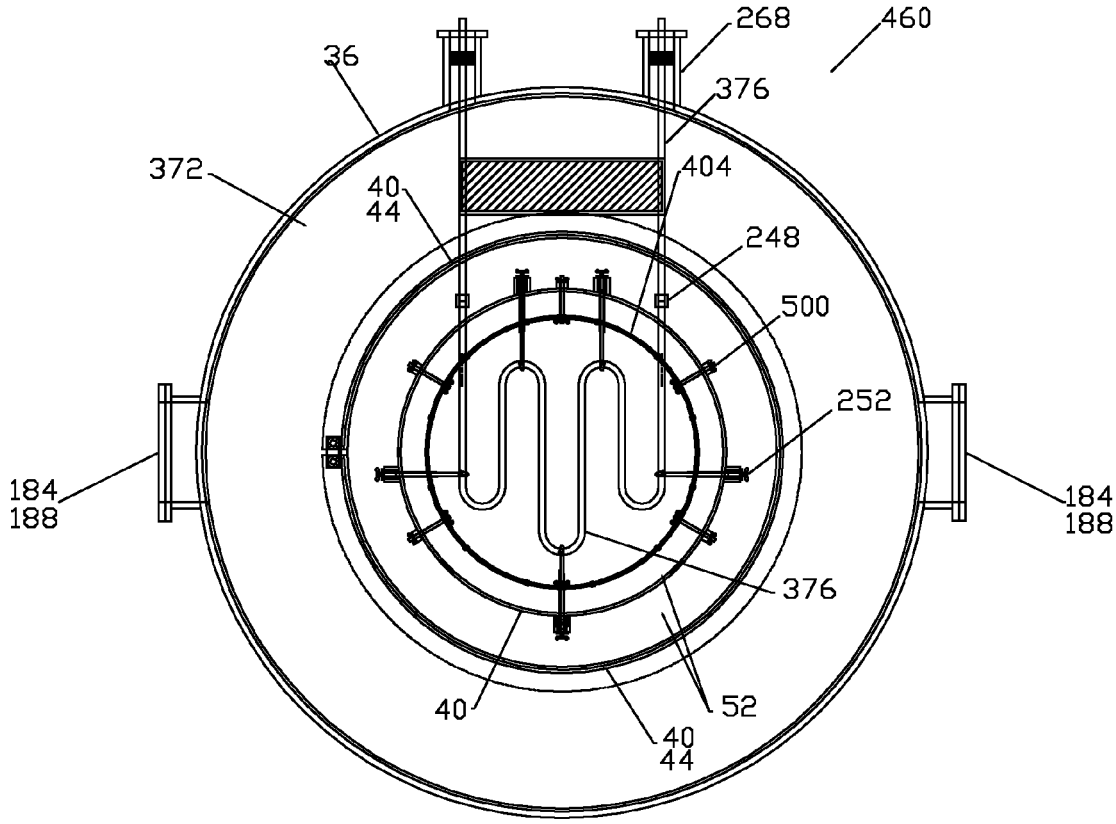
Figure 40:
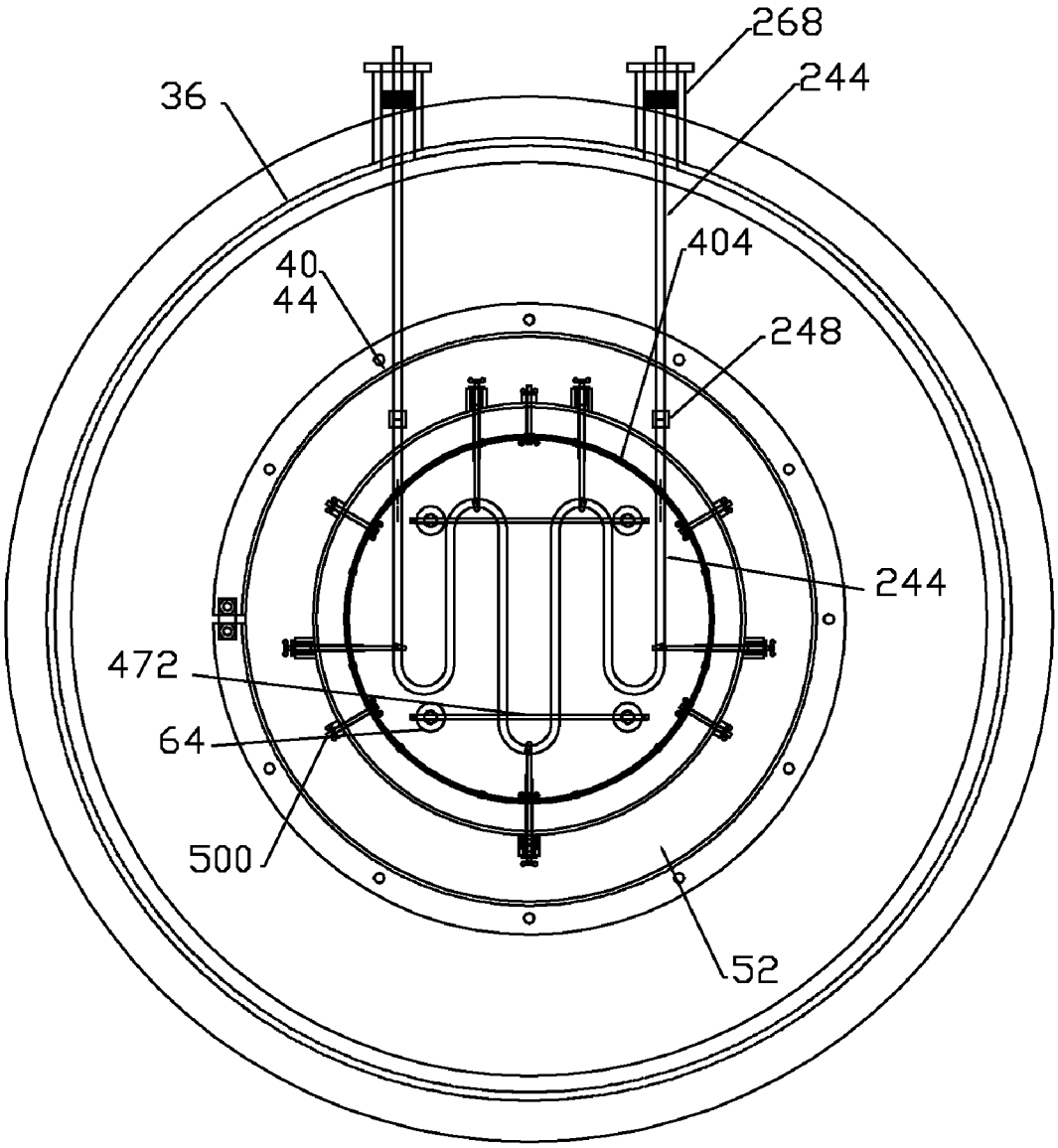
Figure 45:
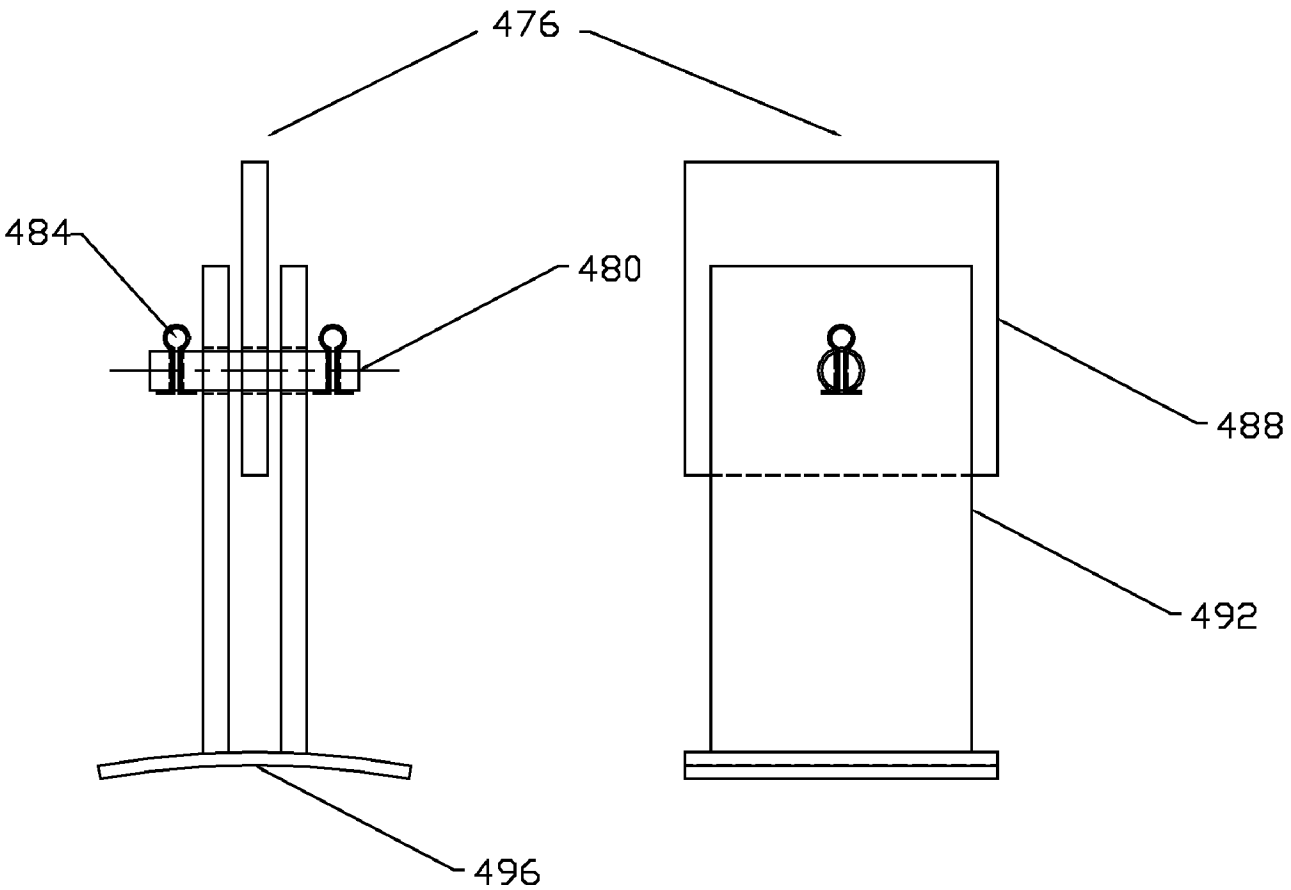
FIG. 45. is a generally rounded vertical hot zone support assembly
Figure 46:
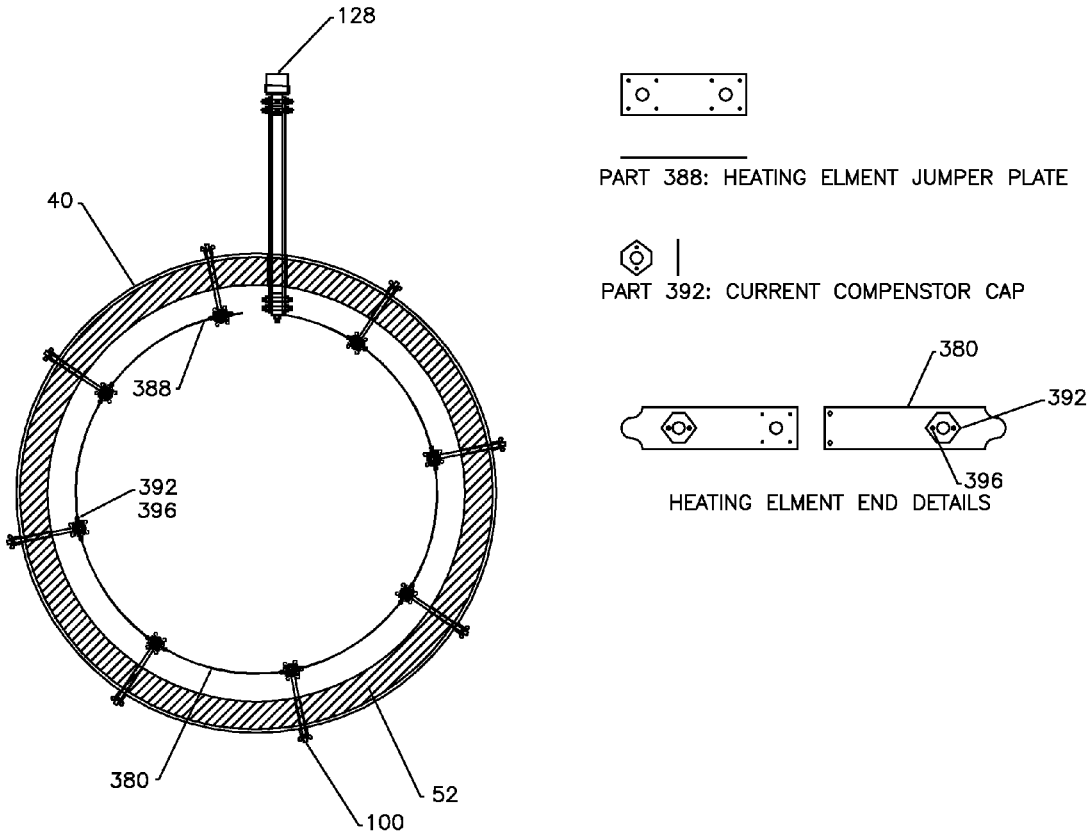
FIG. 46. is a heating element assembly for a generally rounded vertical hot zone usable with a generally vertical furnace FIG. 47. is a bottom section assembly with a generally rounded muffle usable with a generally vertical furnace FIG. 48. is a top section assembly with a generally rounded muffle usable with a generally vertical furnace
Figure 47:
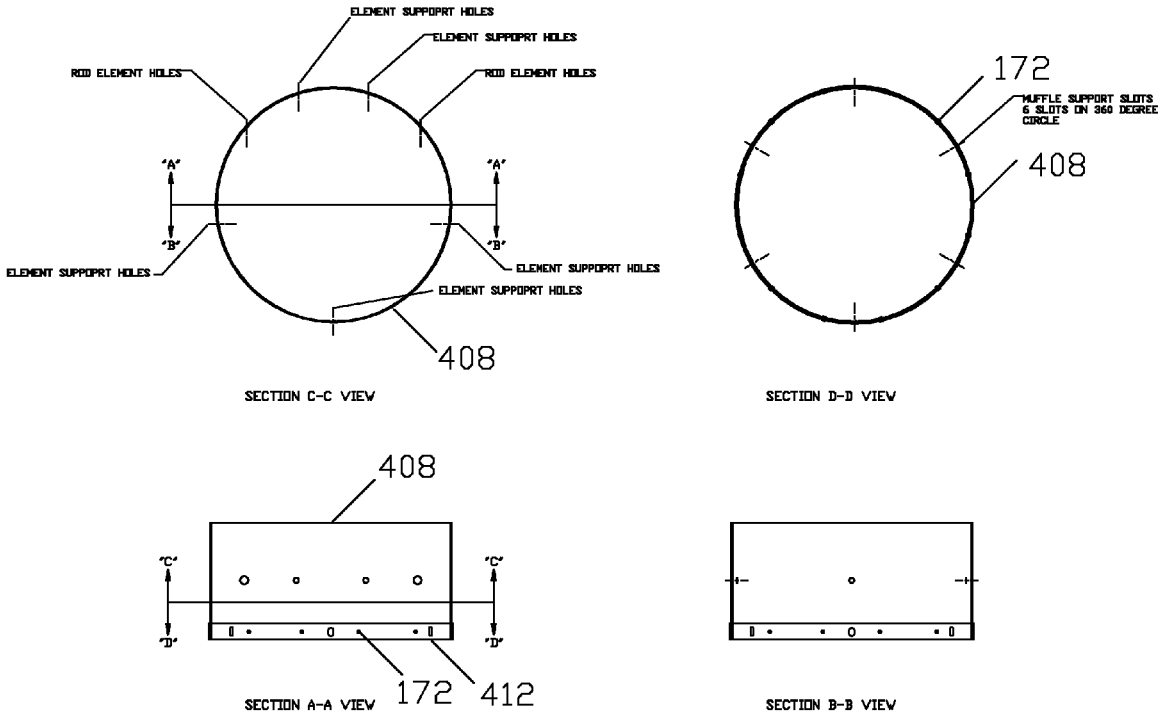
Figure 48:
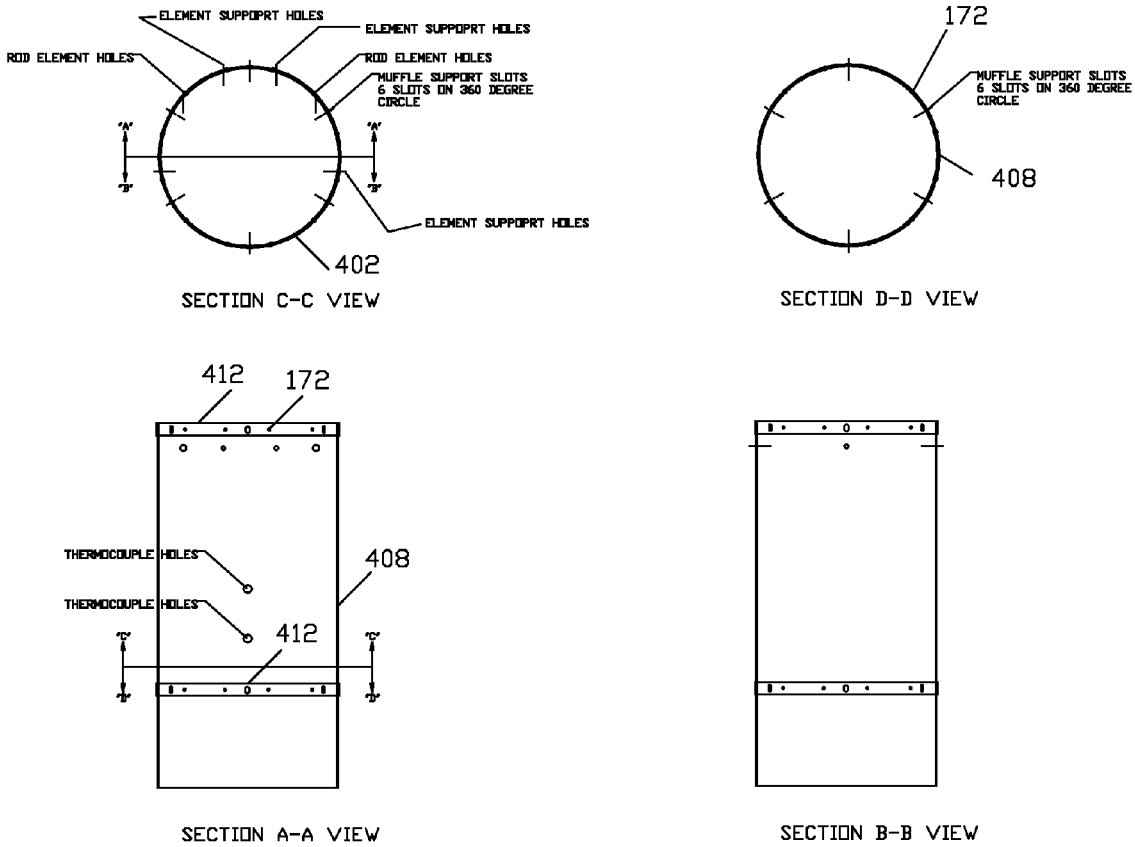

Referring now primarily to FIGS. 37 to 48, an alternate embodiment of the invention is shown. It will be appreciated that the vacuum furnace is shown generally vertically with a generally rounded muffle and a generally rounded hot zone. It should be noted that similarly numbered structures and/or components may be employed for the generally horizontal and the generally vertical vacuum furnaces. Unless otherwise indicated or made clear by the context, similarly named and/or numbered structures and/or components may function and/or operate analogously for the generally horizontal and the generally vertical vacuum furnaces. The generally rounded muffle type employed in FIG. 37 are shown in FIGS. 47-48.

The generally vertical vacuum furnace illustrated includes an upper gas retainer plate 364 and a lower gas retainer plate 368 as shown. A top gas retainer plate 372 is provided as shown. The upper gas retainer plate 364, the lower gas retainer plate 368, and the top gas retainer plate 372 may be constructed with steel or other suitable material.

A heating element assembly 380 is shown, in detail in FIG. 46, for the generally vertical vacuum furnace. The illustrated heating element assembly 380 includes a heating element 384. The illustrated heating element 384 is generally circular. The vacuum furnace shown in FIG. 37 includes six heating elements positioned generally equidistant and generally parallel to each other, though any suitable number and placement may be employed. The illustrated heating element 384 may be approximately three inches wide and approximately 0.020 inches thick, though any suitable size parameters may be employed. A heating element jumper plate 388 and a current compensator cap 392 may also be provided. A suitable number and type of rivets 396 may be employed as shown or otherwise. The heating element 384, heating element jumper plate 388, current compensator cap 392, and rivets 396 may be constructed with a refractory metal or other suitable material. A muffle end cap 400 may be provided a shown. The illustrated muffle end cap 400 is generally circular.

The illustrated generally vertical vacuum furnace may include a hot zone top door 460 and a hot zone bottom door 464, as shown in FIG. 10. The generally vertical vacuum furnace may include a hearth post 472. The illustrated vertical vacuum furnace includes two such hearth posts, though any suitable number and placement may be employed. The generally vertical vacuum furnace may include a hearth bar 468. The illustrated vertical vacuum furnace includes two such hearth bars, though any suitable number and placement may be employed. The hearth post(s) and hearth bar(s) may be constructed with a refractory metal or other suitable material.

Figure 36:
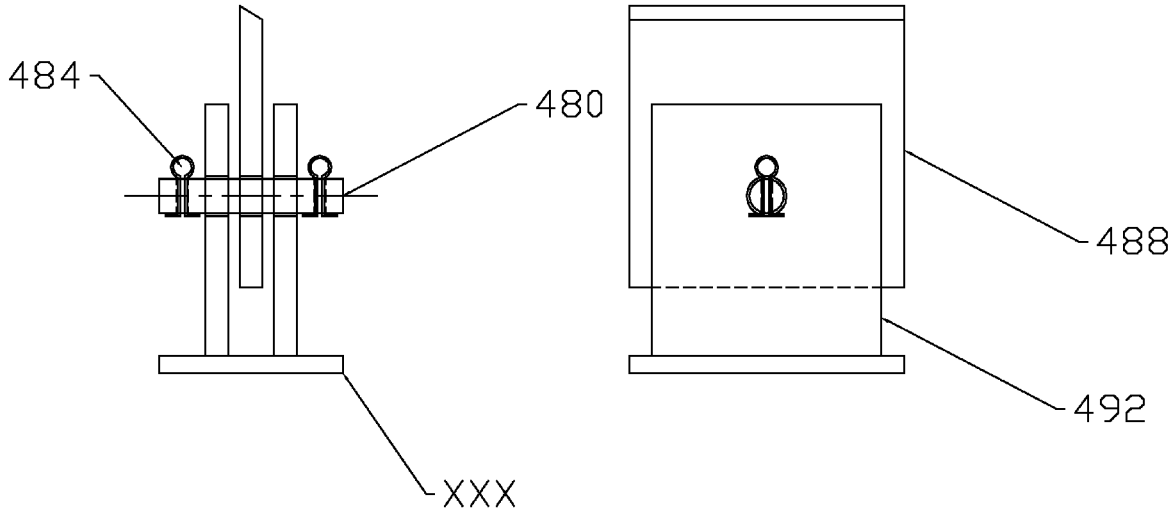
FIG. 36. is a vertical (rectangular) hot zone support assembly

Referring now primarily to FIGS. 36 and 45, the furnace may include a vertical hot zone support assembly 476. The illustrated generally vertical vacuum furnace includes four such vertical hot zone support assemblies, though any suitable number and placement may be employed. The vertical hot zone support assembly 476 includes one or more support rod(s) 480 coupled with a suitable number and placement of cotter pin(s) 484. The support rod(s) 480 support one or more chamber support plate(s) 488 and support plate(s) 492. A gusset plate 496 is shown secured to two support plates 492. The components of the vertical hot zone support assembly 476 may be constructed with steel or other suitable material.

Figure 35:
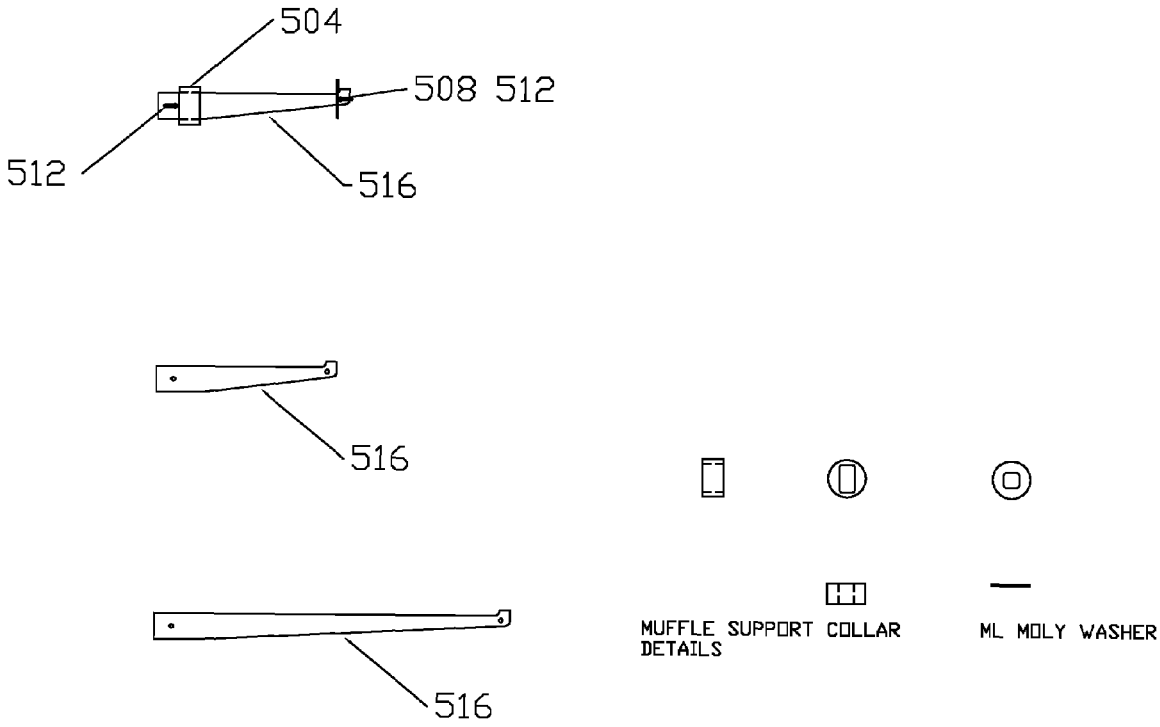
FIG. 35. is a vertical muffle anchor assembly useable with the generally vertical furnace of FIGS. 10 and 37

FIG. 35. shows a vertical muffle anchor assembly 500 useable with the generally vertical furnace of FIG. 37. The vertical muffle anchor assembly 500 may include a collar 504 operatively connected to an anchor body 516. The anchor body 516 may support a washer 508 and a wire loop 512. The vertical muffle anchor assembly 500 is shown at an upper region and a lower region of the generally vertical furnace of FIG. 37. An anchor body 520 may also be employed in a mid region of the generally vertical furnace of FIG. 37.

Figure 41:
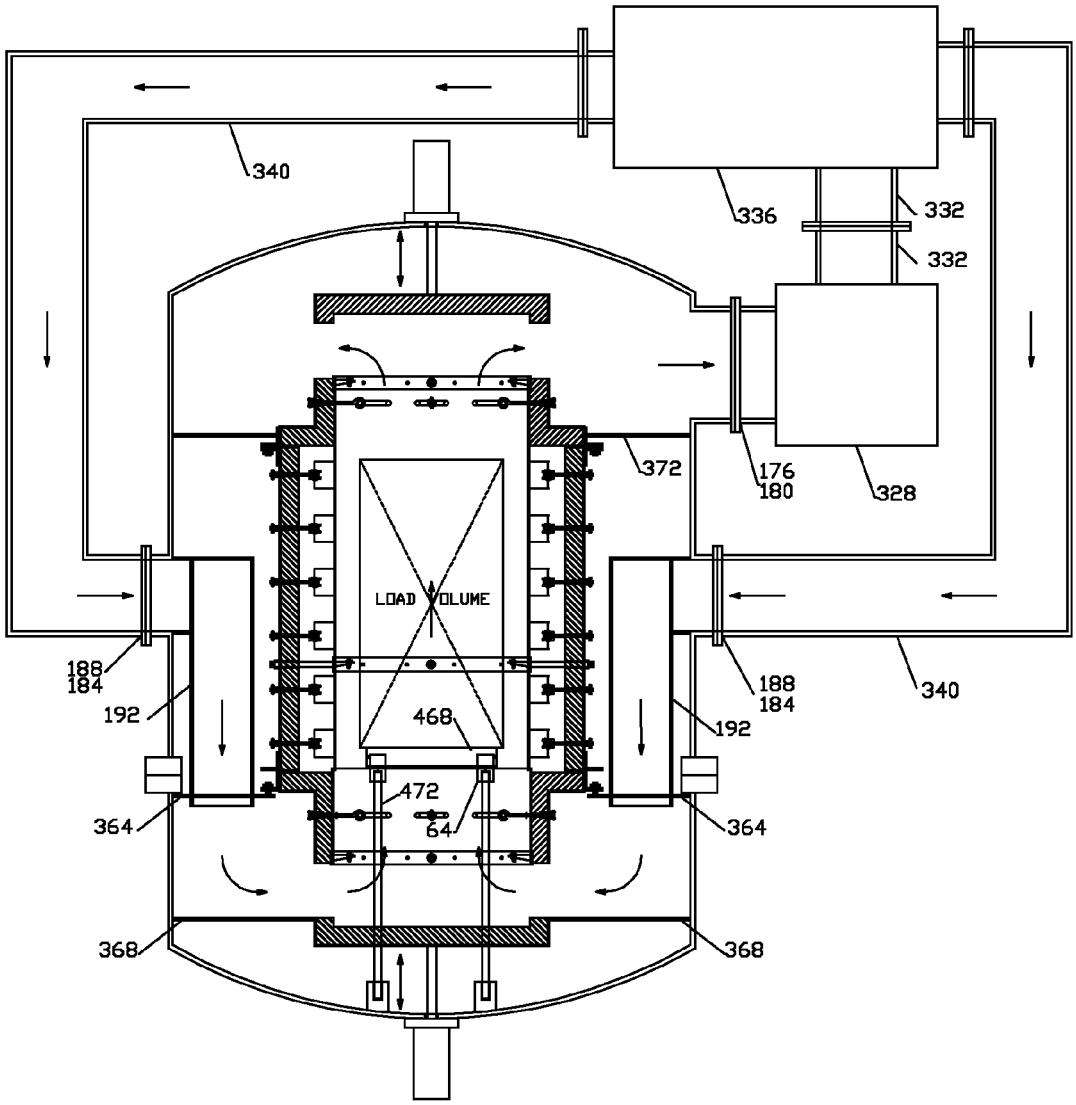
Figure 42:
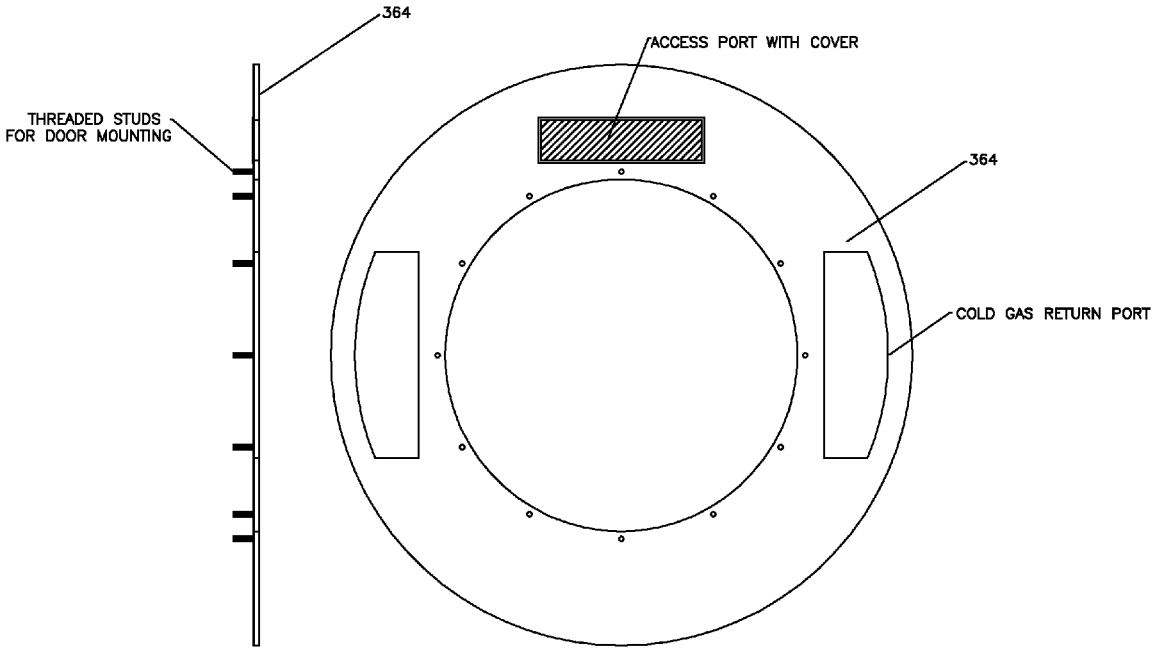
Figure 43:
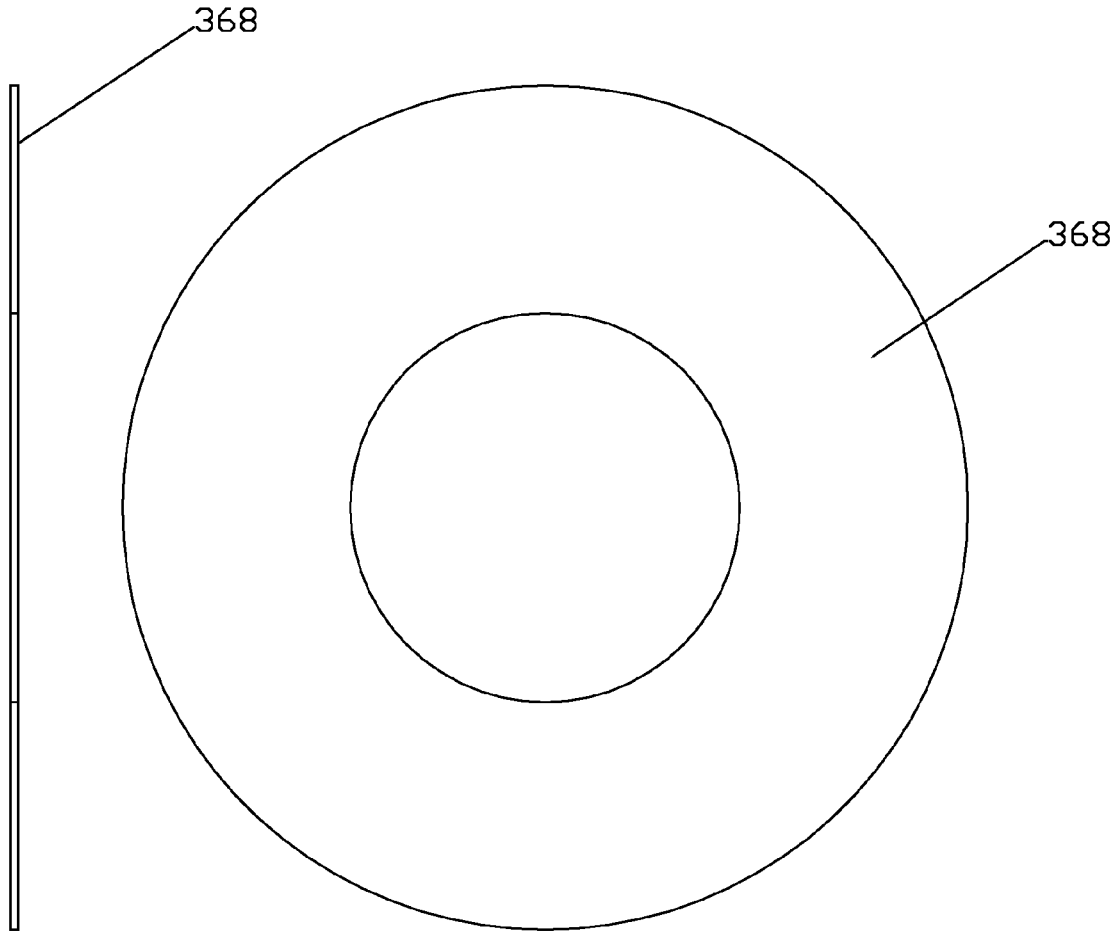
FIG. 43. is a lower gas retainer plate (bottom door)
Figure 44:
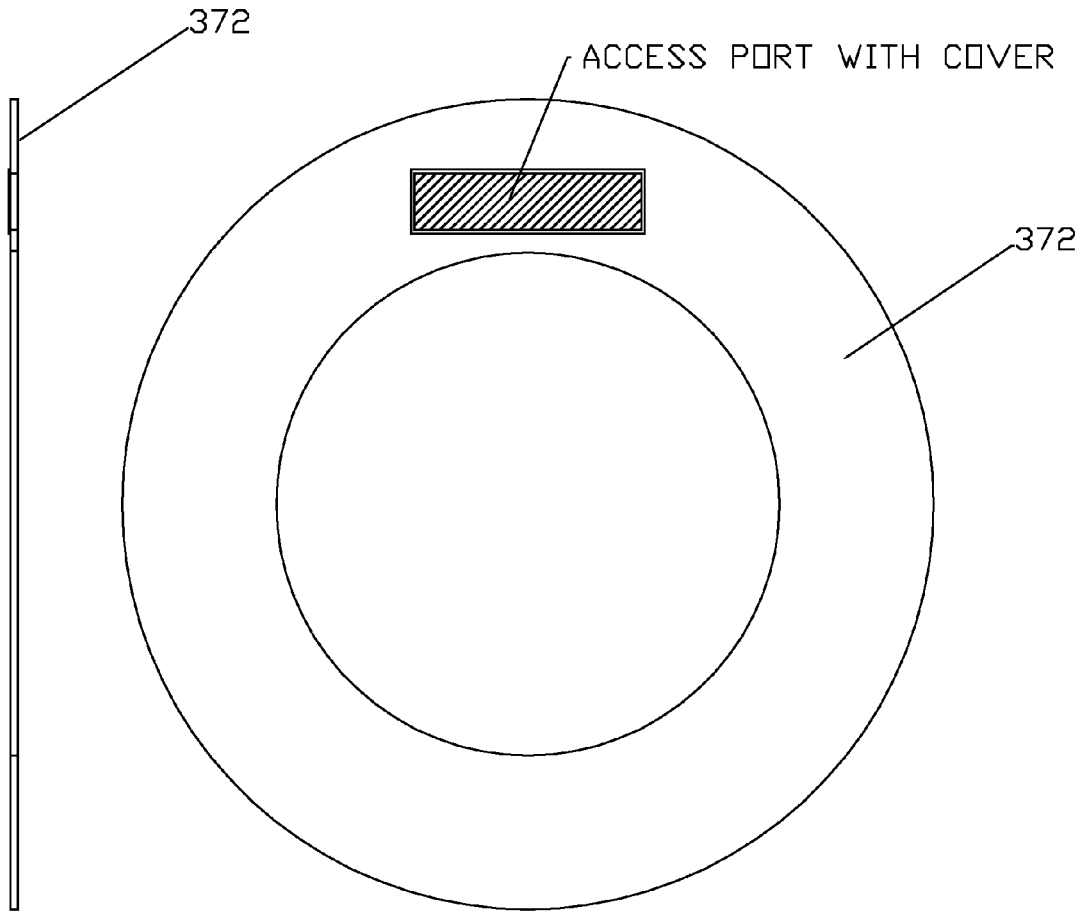
FIG. 44. is a top gas retainer plate (top door)

Referring now primarily to FIG. 41, the generally vertical vacuum furnace is operable in a cooling mode. The cooling mode shown in FIG. 41 is analogous to the cooling mode shown in FIGS. 5 and 8 for the generally horizontal vacuum furnace. The generally vertical vacuum furnace is shown in a cooling mode. The term "cooling mode" is understood to include a particular functioning arrangement or condition that facilitates cooling of the load compared to other modes, such as for example a heating mode. The illustrated invention includes a high temperature fan and motor 328. The high temperature fan and motor 328 are preferably adapted to accommodate extreme temperatures. A hot gas piping 332 is provided in fluid communication with a heat exchanger 336. Any suitable heat exchanger 336 may be employed, though a water cooled shell and tube model may be considered. A cold gas return piping 340 is positioned as shown downstream of the heat exchanger 336. As indicated by the arrows, a suitable fluid moves though the muffle 72, and thus the load in the muffle, to cool the load. It should be noted that the fluid moves in a substantially unidirectional flow within the muffle. The fluid flows in a substantially unidirectional flow through the muffle. It will be noted that the muffle end caps 400 are retracted, allowing for muffle fluid flow, and thus cooling.

Alternate embodiments may be employed and design advantages may be included. Rivets may be replaced by any other suitable fastener or joining means. A conventional vacuum furnace door with a fixed shield pack with elements and nozzles could be used. Also, gas could be admitted to the muffle thought an annular ring or set of slots in the vacuum furnace doors or thought openings in the side wall of the muffle. The mechanical arrangement of the vacuum furnace may be varied. The present design has the fan and heat exchanger located externally to the main vacuum chamber (which contains the hot zone). We are aware that the fan and heat exchanger could be located inside the main vacuum chamber. A vertical flow muffle could be made that is split vertically to allow for side loading, in addition to the of the bottom loading employed.

The muffle substantially confines the flowing cooling gas to cooling the load, part of the load support assembly and the muffle. These load is cooled by forced convection at a generally higher rate than a conventional vacuum furnace. The rest of the hot zone cools more slowly by natural convection and radiation. The load and the muffle may be cooled faster than the rest of the hot zone. This may lead to a longer hot zone life due to lower contraction rates and less gas erosion in the hot zone. The muffle allows for more uniform radiant heating than conventional vacuum furnace hot zones. The muffle exposes more of the load versus less with conventional band heating elements. The muffle evens out the variations in radiation intensity from the elements. The muffle allows generally more uniform heating of the load than use of heating elements alone. The illustrated muffle is not necessarily gas tight. This feature may allow the muffle to be more lightweight. When a shorter and longer muffle are employed, the shorter muffle may be positioned radially outwardly of the longer muffle. The shorter muffle may slide over the longer muffle as desired.

Any suitable and varying temperatures may be employed as required by the uses desired. The load may be subjected to temperatures of about 3,000 degrees Fahrenheit or other suitable temperatures or ranges. The load may be subjected to cooling by the fluid within the range of from about 140 to about 2,500 degrees Fahrenheit or other suitable temperatures or ranges. The muffle and the vacuum furnace may be oriented generally horizontally and/or generally vertically as desired.

In operation, the invention may operate in cooling modes and heating modes. Means for cooling the load include the heat exchanger, the fan and/or a water jacket on the furnace chamber. The end cap(s) of the vacuum furnace is/are moveable to facilitate cooling or operation in a cooling mode. The cooling modes may employ one or more of the following steps, processes, or aspects;

1. Turn off heating element,
2. Fill chamber with fluid,
3. Open doors and/or turn on fan to circulate fluid. Backfill valves and exhaust components (not shown) may be employed as desired.

It will be appreciated that at least one of the means for heating the fluid is preferably located substantially within at least one end of the muffle. Likewise, the heating modes may employ one or more of the following steps, processes, or aspects;

1. Evacuate gas from chamber,
2. Close doors,
3. Turn on, activate, or turn up heating elements,
4. Circulate fluid as appropriate.

It is to be understood that the invention is not limited in its application to the details of construction and to the arrangements of the components set forth in the accompanying description or illustrated in the drawings. The invention is capable of other embodiments and of being practiced and carried out in various ways. Also, it is to be understood that the phraseology and terminology employed herein are for the purpose of description and should not be regarded as limiting. The disclosure may readily be utilized as a basis for the designing of other structures, methods and systems for carrying out the present invention. It is important, therefore, that the claims be regarded as including equivalent constructions. Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract and disclosure are neither intended to define the invention of the application, which is measured by the claims, nor are they intended to be limiting as to the scope of the invention in any way.

What is claimed is:

1. A vacuum furnace for cooling a load comprising:

a vacuum chamber, an insulated hot zone shell contained within the vacuum chamber, a muffle contained within the hot zone shell, the muffle having opposed open ends and containing the load, one or more heating means within the hot zone shell and substantially surrounding an exterior portion of the muffle, a door which can be opened at each of the opposed ends of the muffle, heating means located within each end of the muffle, a pair of end caps that close the opposing ends of the muffle, the caps substantially in contact with each of the doors, the end caps being retractable to open both ends of the muffle for cooling a load, and a heat exchanger and a fan for executing a cooling mode.

2. The vacuum furnace of claim 1 further comprising a turntable to rotate the load.

3. The vacuum furnace of claim 1 wherein the muffle is oriented generally horizontally.

4. The vacuum furnace of claim 1 wherein the muffle is oriented generally vertically.

5. The vacuum furnace of claim 1 wherein the muffle is generally rounded.

* * * * *